US010010130B2

(12) United States Patent
Fraser

(10) Patent No.: US 10,010,130 B2
(45) Date of Patent: Jul. 3, 2018

(54) ARTICLE OF FOOTWEAR DESIGNED TO IMPART CONTROLLED SPIN ON A BALL WHEN KICKED WITH THE TOES

(71) Applicant: Neil Richard Fraser, Loveland, OH (US)

(72) Inventor: Neil Richard Fraser, Loveland, OH (US)

(73) Assignee: Neil Richard Fraser, Loveland, OH (US)

( * ) Notice: Subject to any disclaimer, the term of this patent is extended or adjusted under 35 U.S.C. 154(b) by 0 days.

(21) Appl. No.: 15/344,122

(22) Filed: Nov. 4, 2016

(65) Prior Publication Data

US 2018/0125150 A1 May 10, 2018

(51) Int. Cl.

| | |
|---|---|
| ***A43B 23/08*** | (2006.01) |
| ***A43B 5/02*** | (2006.01) |
| ***A43B 23/02*** | (2006.01) |
| ***A43C 15/16*** | (2006.01) |
| ***A43B 13/04*** | (2006.01) |
| *A43B 7/32* | (2006.01) |

(52) U.S. Cl.

CPC ..... *A43B 5/025* (2013.01); *A43B 13/04* (2013.01); *A43B 23/021* (2013.01); *A43B 23/028* (2013.01); *A43B 23/0215* (2013.01); *A43B 23/087* (2013.01); *A43C 15/16* (2013.01); *A43B 7/32* (2013.01)

(58) Field of Classification Search

CPC ..... A43B 7/32; A43B 5/025; A43B 23/087; A43B 23/028; A43B 13/04; A43B 23/021; A43C 15/16

USPC ..... 36/77 R, 112

See application file for complete search history.

(56) References Cited

U.S. PATENT DOCUMENTS

| | | | | | |
|---|---|---|---|---|---|
| 1,726,198 | A * | 8/1929 | Stahl | A43B 5/02 | 36/128 |
| 2,625,753 | A * | 1/1953 | Null | A43C 13/14 | 36/72 R |
| 2,891,327 | A * | 6/1959 | Leach | A43B 7/32 | 36/4 |
| 6,886,275 | B1 * | 5/2005 | Westfall | A43B 3/20 | 36/128 |
| 2006/0101669 | A1 * | 5/2006 | Santos | A43B 3/24 | 36/77 R |
| 2006/0218821 | A1 * | 10/2006 | Hatzilias | A43B 5/02 | 36/133 |
| 2013/0111783 | A1 * | 5/2013 | Serafino | A43B 5/02 | 36/133 |

FOREIGN PATENT DOCUMENTS

| | | | | |
|---|---|---|---|---|
| DE | 2255628 | * | 5/1974 | A43B 23/081 |
| EP | 2818062 | * | 12/2014 | A43B 3/30 |

* cited by examiner

*Primary Examiner* — Katharine Gracz

(57) ABSTRACT

An article of sports footwear that changes shape in two ways. Firstly, a change of shape occurs when such footwear is used to kick a ball with the toes. This change of shape maximizes the area of contact with a ball that is kicked with the toes. Secondly, a change of shape occurs when the article of sports footwear bends during running. This change of shape shortens the entire length of the article of sports footwear in order to prevent tripping. A flexible toe cap encases the foot and parts of a traditional article of footwear and attaches at or near the tarsometatarsal joint of a wearer.

17 Claims, 31 Drawing Sheets

ARTICLE OF FOOTWEAR DESIGNED TO IMPART CONTROLLED SPIN ON A BALL WHEN KICKED WITH THE TOES

CROSS-REFERENCE TO RELATED APPLICATION

This application claims priority of U.S. provisional patent application Ser. No. 62/254,819, filed Nov. 13, 2015 which is hereby incorporated by reference herein in its entirety.

This application claims priority of U.S. provisional patent application Ser. No. 62/287,941, filed Jan. 28, 2016 which is hereby incorporated by reference herein in its entirety.

TECHNICAL FIELD

A sports shoe includes a flexible toe cap that is able to change shape transiently in order to more accurately kick a ball with spin imparted on the ball.

BACKGROUND

This relates to an article of footwear that is designed to make it easier to impart spin in a controlled manner to a ball when kicked with the toe of the article of footwear. Traditionally, for sports where kicking a ball is involved, coaches teach players to not kick the ball with the toe end of the shoe, the reason being that it is very difficult to control the direction of such ball with traditional footwear. The present embodiment solves this problem by providing an article of footwear that allows accurate kicking of a ball with the toe end of an article of footwear while imparting spin on such ball. Providing the facility to accurately kick a ball with spin is useful to sports players since such spin causes a Magnus effect thereby causing a ball to curve away from the principal direction of flight. This curve of path may be used by players to deceive players of the opposite team, thereby creating more goals or points etcetera. Pelfrey in U.S. Pat. No. 5,718,069 teaches a form of footwear with a flat toe such that the contact area with the ball is as wide as the footwear itself, with the objective to kick the ball accurately with the toe of the footwear. Johnson in U.S. Pat. No. 5,437,112 teaches a form of footwear with a contact pad on the upper surface of the footwear. The pad is designed to support more accurate kicking of a ball when contact is made between the pad and ball. Eder in U.S. Pat. No. 8,356,429 teaches a form of footwear with a lattice of small protrusions that bend so as to cushion the ball for better accuracy of said ball when kicked with the areas of the show containing a lattice. Serafino in International Publication Number WO 2011/150446 teaches a form of footwear with a concave toe end designed to kick a ball accurately when kicked with the toe. Morle in U.S. Pat. No. 6,681,503 teaches a form of footwear with an external tongue with a series of agitators designed to impart spin on the ball when kicked with either side of the foot.

Advantages: None of these solutions deal with the primary problem with kicking a ball with the toe end of a shoe, that is, the fact that the toe end of a show has a smaller area of contact with a ball than, say, a side-foot kick where the ball is kicked with the medial side of the foot.

SUMMARY

An article of sports footwear, including a forefoot section, including a flexible toe cap, which is engineered to substantially change shape in a direction roughly orthogonal to the direction of a kicked sports ball and opposite from the direction of spin of the ball wherein such change of shape substantially increases the average area of contact between the ball and the flexible toe cap during a kick thereby effecting extra spin on the ball.

In addition, the flexible toe cap is able to, after initial change of shape as a result of a reaction force from a kicked ball, snap back to the substantially original shape of the flexible toe cap while still in contact with a kicked ball; thereby providing even more controlled spin to the ball.

In addition, the flexible toe cap is able to reduce its length at the point in a running motion when otherwise an extended length shoe might make a wearer trip.

DETAILED DESCRIPTION

Selective embodiments are hereinafter described in detail in connection with the views and examples of FIGS. 1-15, wherein like numbers often indicate the same or corresponding elements throughout the views. This detailed description discusses exemplary embodiments in the form of a soccer shoe; however the present embodiment could take the form of any article of footwear. This detailed description mostly shows examples of an article of footwear that are illustrated for a right foot, however it should be understood that this detailed description may equally apply to mirror images that are intended for a left foot.

This detailed description is broken down into two distinct sections. The first section details the construction of various embodiments. The second section details the operation of these embodiments.

Construction of Various Embodiments

In a first embodiment, the end piece of the article of footwear is designed to change shape in a non-intuitive direction upon application of a force by the ball acting on the footwear and then return to a resting position after the ball is kicked.

Figure 1:
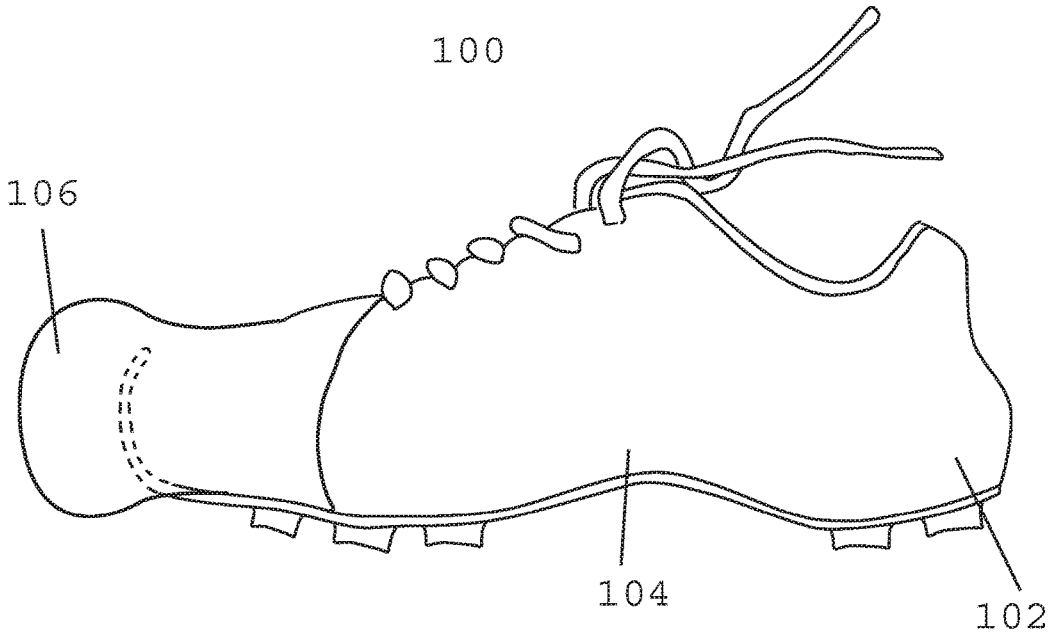
FIG. 1 shows an exemplary aspect as viewed from the side

Referring now to FIG. 1, article of footwear 100 may include a heel section 102, a midfoot section 104 and a forefoot section 106. The heel section 102 is generally associated with the heel of a foot. Likewise the midfoot section 104 is generally associated with the arch of a foot. The forefoot section 106 is generally associated with the toes of a foot. Article of footwear 100 may also be referred to as article 100 for reasons of brevity.

Figure 2:
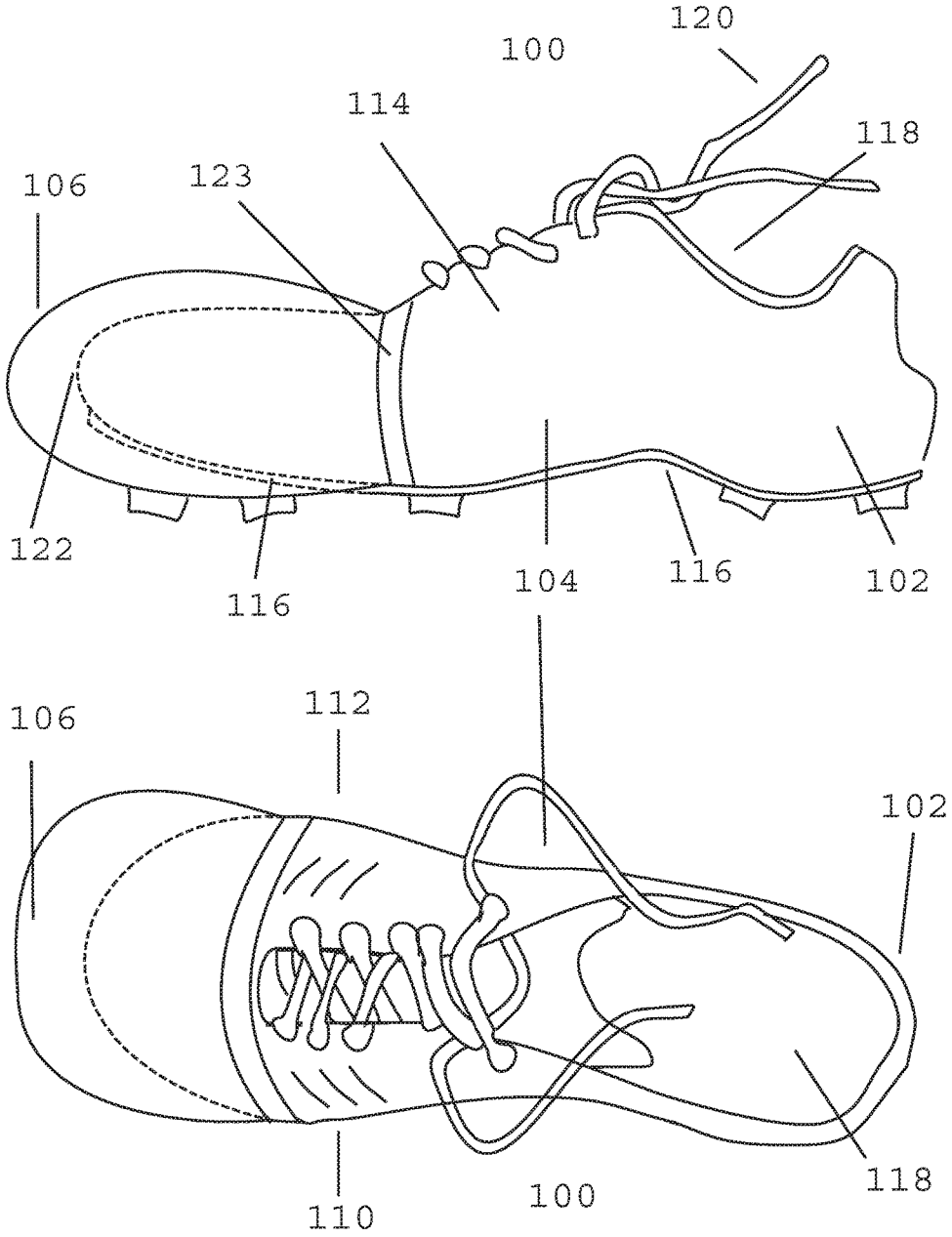
FIG. 2 shows an exemplary aspect as viewed from the side and above

Referring now to FIG. 2, article 100 may include a medial section 110 and a lateral section 112 which may be opposite sides of each other and extend through section 102, section 104 and section 106. It should be understood that section 102, section 104, section 106, section 110 and section 112 are separated for descriptive reasons and are not intended to precisely demarcate areas of article 100. Article 100 may also include an upper section 114 and a sole section 116. The configuration of the upper section 114 may vary widely in different embodiments. Upper section 114 may be any type of upper. Upper section 114 may have any design, shape, color or size. Generally, upper section 114 may be made from any suitable material including, but not limited to, leather, synthetic leather, synthetic rubbers, natural rubber, plastics and elastomers. Upper section 114 typically may be configured to allow entry of a foot via an entry hole 118. The configuration of the sole section 116 may vary widely in different embodiments. Section 116 may be connected to the upper components of article 100 by means such as adhesion or stitching. In some cases the configuration of the sole section may be varied in order to be more effective on different ground surfaces. For example, sole section 116 may have cleats attached to it for the purpose of providing better traction with the ground. In other embodiments sole section 116 may have a relatively flat surface. Sole section 116 may be made from any suitable material including, but not limited to, synthetic rubbers, natural rubber, plastics and elastomers. Article 100 may also include a lace 120, used to tighten article 100 to a human foot. In other cases other facilities are provided to perform such tightening including, but not limited to, Velcro. Article 100 may also include a toe cover 122 which may be an extension of sole 116 curving into a generally concave shape to protect the toes. Section 106 attaches to section 100 at points along line 123 which circles article 100 including sole 116.

For purposes of clarity, only some parts of section 102, section 104, section 106, section 110, section 112, section 114 and section 116 are discussed in this exemplary embodiment. It should be understood that section 102, section 104, section 106, section 110, section 112, section 114 and section 116 may include other provisions that are known in the art for assisting with walking, running, kicking a ball and other athletic endeavors.

References to either "left" or "right" as used throughout this detailed description and claims are intended to be from the perspective of the kicker of a ball, that is, from the perspective of a person looking in the direction from heel section 102 to forefoot section 106.

The term "lateral", as used throughout this detailed description and claims is intended to convey the direction between medial section 110 and lateral section 112 or between lateral section 112 and medial section 110.

The term "longitudinal", as used throughout this detailed description and claims is intended to convey the direction between heel section 102 and forefoot section 106 or from forefoot section 106 to heel section 102.

The term "elastic" as used throughout this detailed description and claims is intended to convey a property whereby a material is able to resume its normal shape spontaneously after contraction, dilatation, distortion or other movement generated by some force.

Article 100 may include a forefoot section 106 whereby one purpose of such forefoot section is to allow kicking of a ball whereby the direction of the ball is accurately controlled and substantial spin is applied to such ball when contact is made between part, or all of forefoot section 106 and such ball.

Figure 3A:
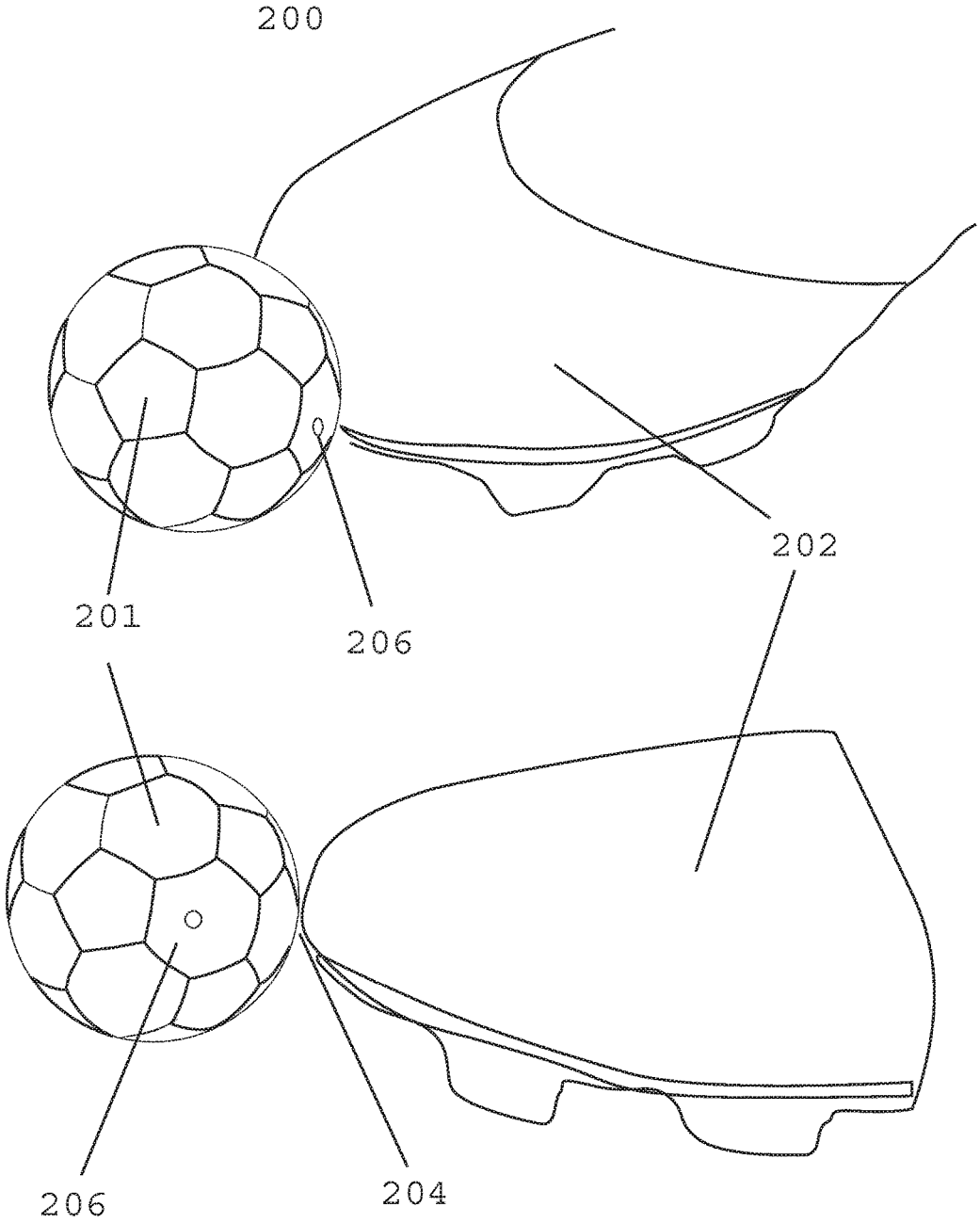
FIG. 3A shows some of the elements used to create one exemplary aspect

Referring now to FIG. 3A, which is intended to show one of the two primary components used to create a moveable flexible toe cap in this first exemplary embodiment. Article of footwear 200 is made up of a number of components. A front section may be created as a small hollow spherical inflatable ball, section 201, physically attached, using adhesives, stitching or other means, to a conventional sports shoe toe section 202, however sections 201 and 202 may be created or molded as a single unit and created from rubber, synthetic rubber or other material. Conventional sports shoe toe section 202 may be made from materials typically used to create the toe section of a sports shoe. Sports shoe toe section 202 may be attached to ball section 201 at point 204. Upon manufacture and prior to attachment of other components, section 201 may be largely deflated by means such as inflation and deflation valve 206.

Figure 3B:
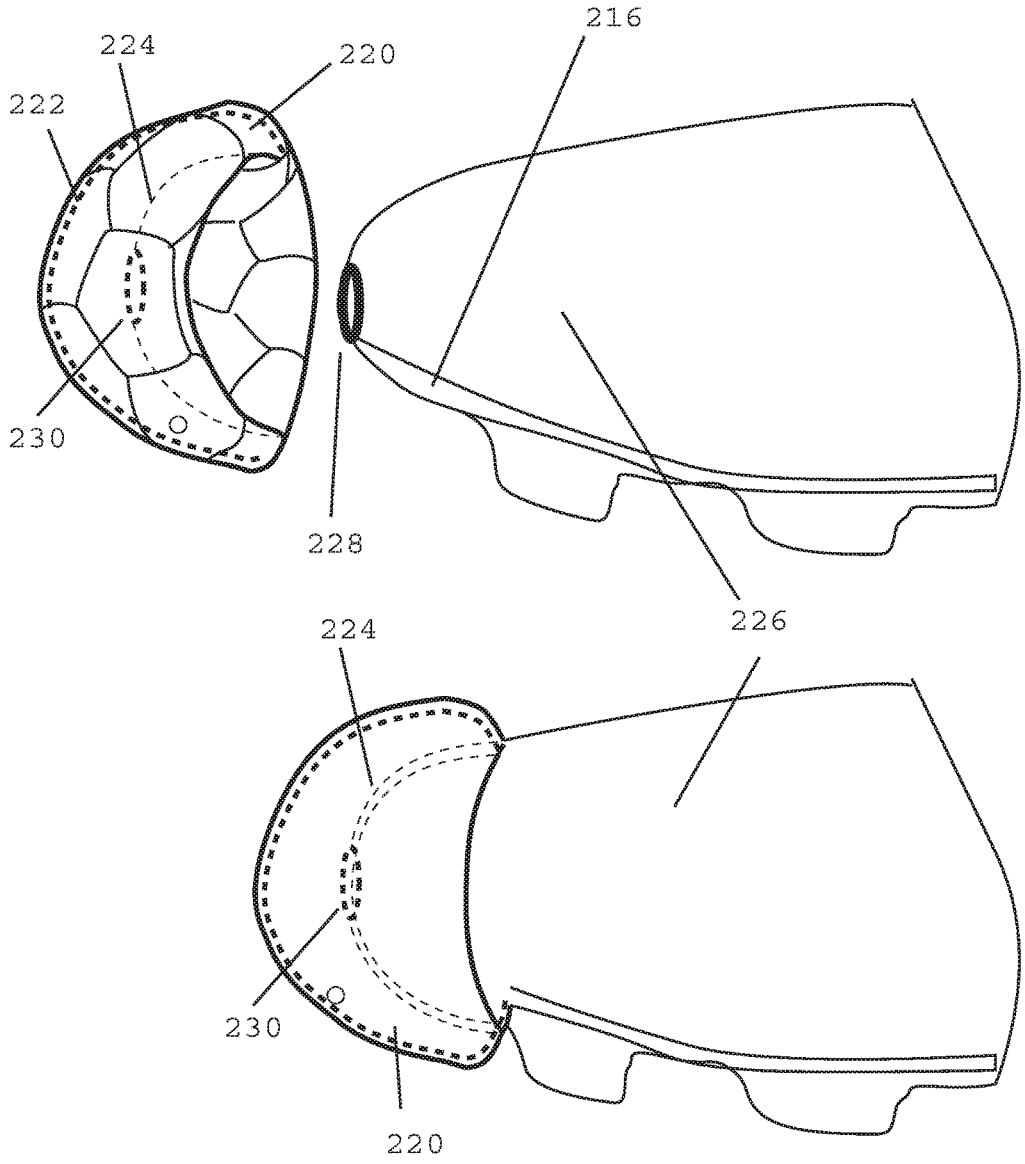
FIG. 3B shows how some of the elements of FIG. 3A may be fastened together

Now referring to FIG. 3B, which continues to describe the embodiment of FIG. 3A, sole section 216 supports the base of the article of footwear. The small ball, labeled as section 201 from FIG. 3A may be deflated to look like ball section 220 in FIG. 3B, some air or gas remaining in ball section 220 such that, internal surface points 222 and 224 of ball section 220 are prevented from touching each other by the remaining air or gas inside the ball, thus minimizing friction when a shearing force moves ball section 220 from side to side or up or down. Sports shoe toe section 226 may be attached to ball section 220 at points 228 on section 226 and points 230 on ball section 220, thereby allowing much of ball section 220 to move freely. Inner ball surface 224 and connection point 230 are shown in broken line since these would otherwise be invisible. This convention may be repeated through other figures. Sports shoe toe section 226 may be attached to the remainder of the sports footwear by various conventional means. Ball section 220 may be made from materials typically used to create a flexible sports ball such as rubber, synthetic rubber, a type of elastomer or other similar flexible material.

Figure 3C:
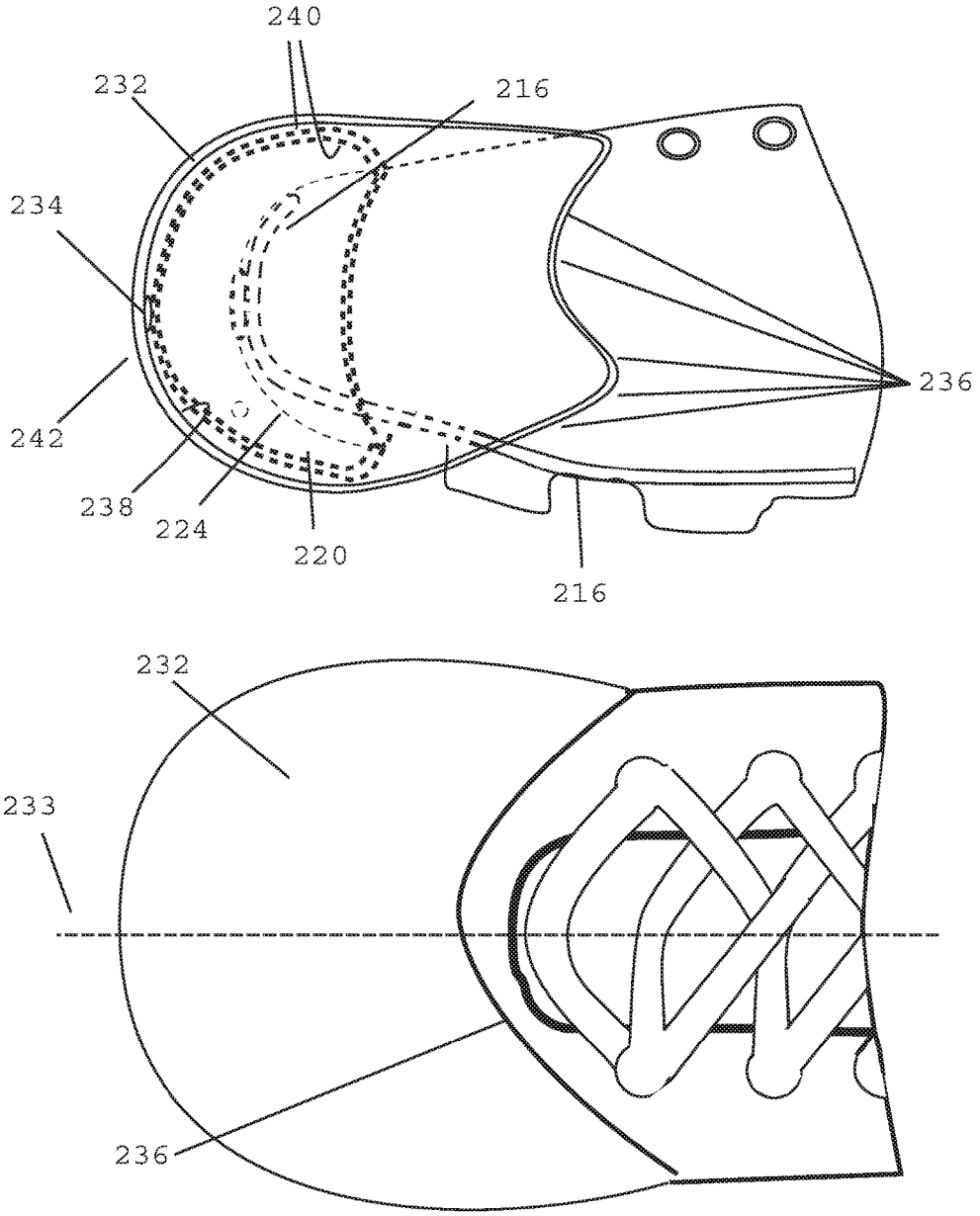
FIG. 3C shows a cross sectional and upper view of the outer skin of one exemplary aspect covering the components described in FIGS. 3A and 3B

Now referring to FIG. 3C which shows a cross sectional view and an upper view of all components of FIG. 3B, flexible skin 232, not shown in FIG. 3B for simplicity of illustration, may be made from rubber, synthetic rubber or other flexible materials. The cross section shown is along imaginary longitudinal plane 233. Flexible skin 232 may be attached to ball section 220 at point 234 using methods including adhesion or stitching. As ball section 220 moves in directions including left, right, upward or downward, under a reaction force from a kicked sports ball, flexible skin 232 is stretched. As such reaction force reduces, flexible skin 232 may snap back ball section 220 to or beyond a pre-kick resting location. As this temporary reaction force from the ball diminishes, two effects may cause flexible skin 232 and components inside of the skin to snap back to the initial position or even further; such effects being the decompression of the previously compressed gas and, secondly, the elastic effect of stretched outer skin 232. Such snap back may push upon a rim of a dimple in a kicked ball and may add rotational force upon a glancing kick and cause the kicked ball to spin more than would otherwise be the case without the snap back effect.

Flexible skin 232 may be attached to the body of a sports shoe at edge points 236 all around the shoe body including the sole. Such attachment may be effected by adhesion, stitching or other means common in the manufacture of a sports shoe. Attachment just at the edges of flexible skin 232 may increase the amount of elasticity in flexible skin 232 since much of the material is unconstrained in location. The internal surface 238 of flexible skin 232 and both surfaces 240 of section 220 and external surfaces 224 may be coated with a low friction material to reduce friction in case of contact between such surfaces during compression caused by a kick. The external surface 242 of flexible skin 232 may be a high friction surface for contact with a kicked ball. One variation of this exemplary embodiment may be where air or gas inside article 220 is partially replaced with a liquid such as an oil in order to provide lower friction between internal surfaces of section 220 and therefore freedom of movement even if internal surfaces of section 220 touch during a kick. Sole section 216 may extend upward in a curve in order to protect the toes of a wearer. In other embodiments section 220 may not be one single chamber of gas but rather a series of chambers that may be connected.

Figure 4:
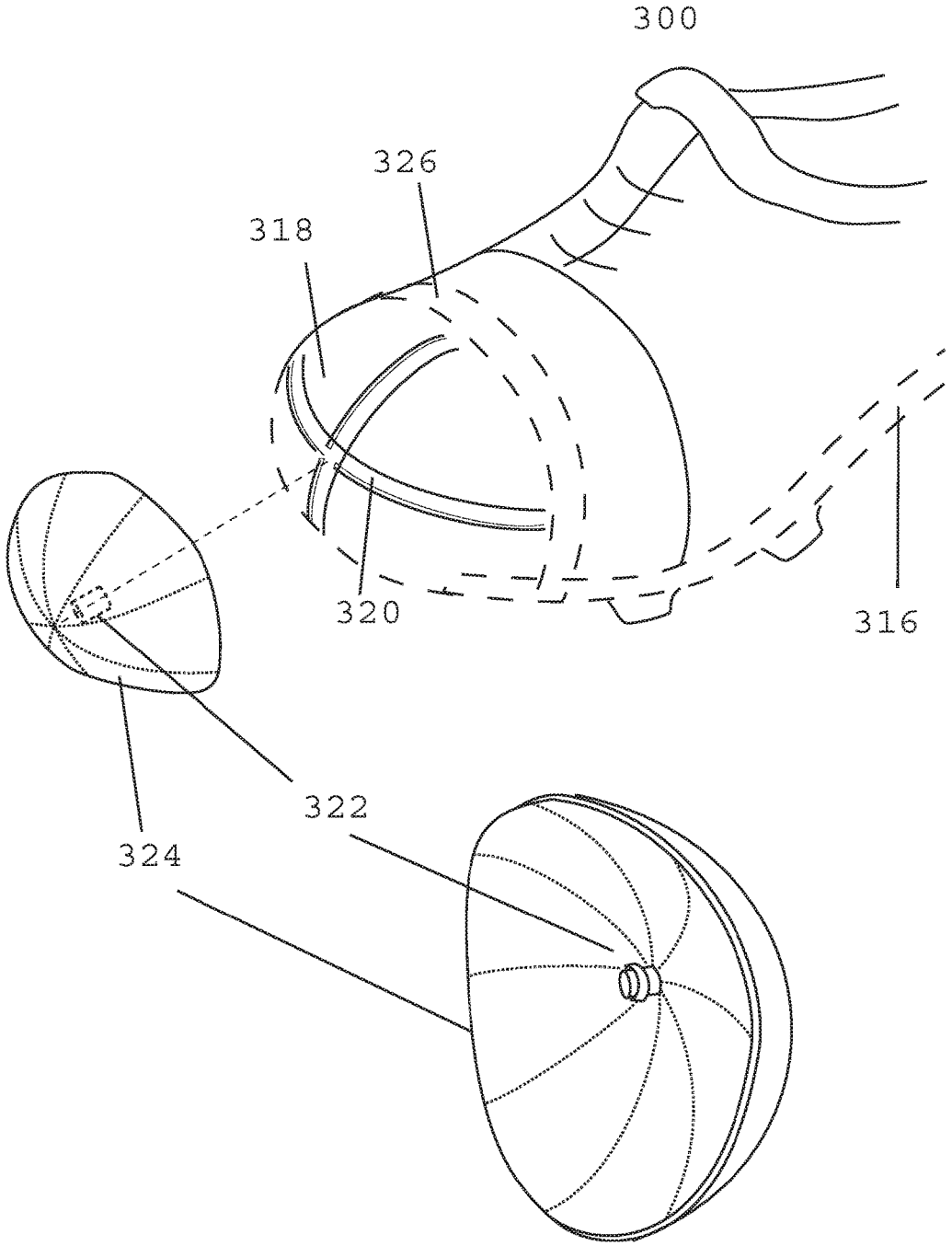
FIG. 4 shows another exemplary aspect

In another embodiment, the change of shape of a flexible toe cap may be effected by other than elastic and pneumatic means including mechanical movement or a combination of mechanical movement and elastic means. Referring now to FIG. 4, showing article 300, an article of footwear, with parts of the flexible toe cap separated for illustrative purposes; sole 316 extends up to concave section 318 as shown as a broken line. Sole section 316 and concave section 318 may be manufactured as a single molded unit. In some embodiments sections 316 and 318 may be connected to the upper components of article 300 by means such as adhesion or stitching. Slots 320 in sole 316 may provide pathways for a guide protrusion 322 to move through, to guide a mechanically moveable front piece 324 of article 300 to possibly move in one of four directions based on the reaction force applied by a kicked ball to forefoot mechanically moveable front piece 324. Such slots may also be created by a molding process or may be later cut from concave section 318 by machine. Mechanically moveable front piece 324 may be made of a flexible material, such as rubber, that distends when pressed in order that mechanically moveable piece 324 can better tessellate with a dimple in a kicked ball. The mechanical movement of moveable piece 324 allowing it to be in an appropriate location near the center of such dimple. Broken lines on section 324 are provided for illustrative purposes to convey the shape of section 324 and do not imply mechanical features. Referring now to the bottom part of FIG. 4, showing the inside of moveable front piece 324 from a different viewing angle; the concave inside portion of moveable front piece 324 may house a guide protrusion 322 which fits into slots 320. Guide protrusion 322 may be made from plastic, rubberized plastic or other similar material and may be bonded, stitched, molded or otherwise fastened to section 324. Referring again to the top part of FIG. 4, mechanically moveable front piece 324 may be connected to Article 300 on line 326. Such connection may be effected by adhesives or stitching or other means known to those familiar with the art. This entire flexible toe cap may be substantially larger than that shown and may extend backward to an attachment point at or near the tarsometatarsal joint of a wearer.

Figure 5:
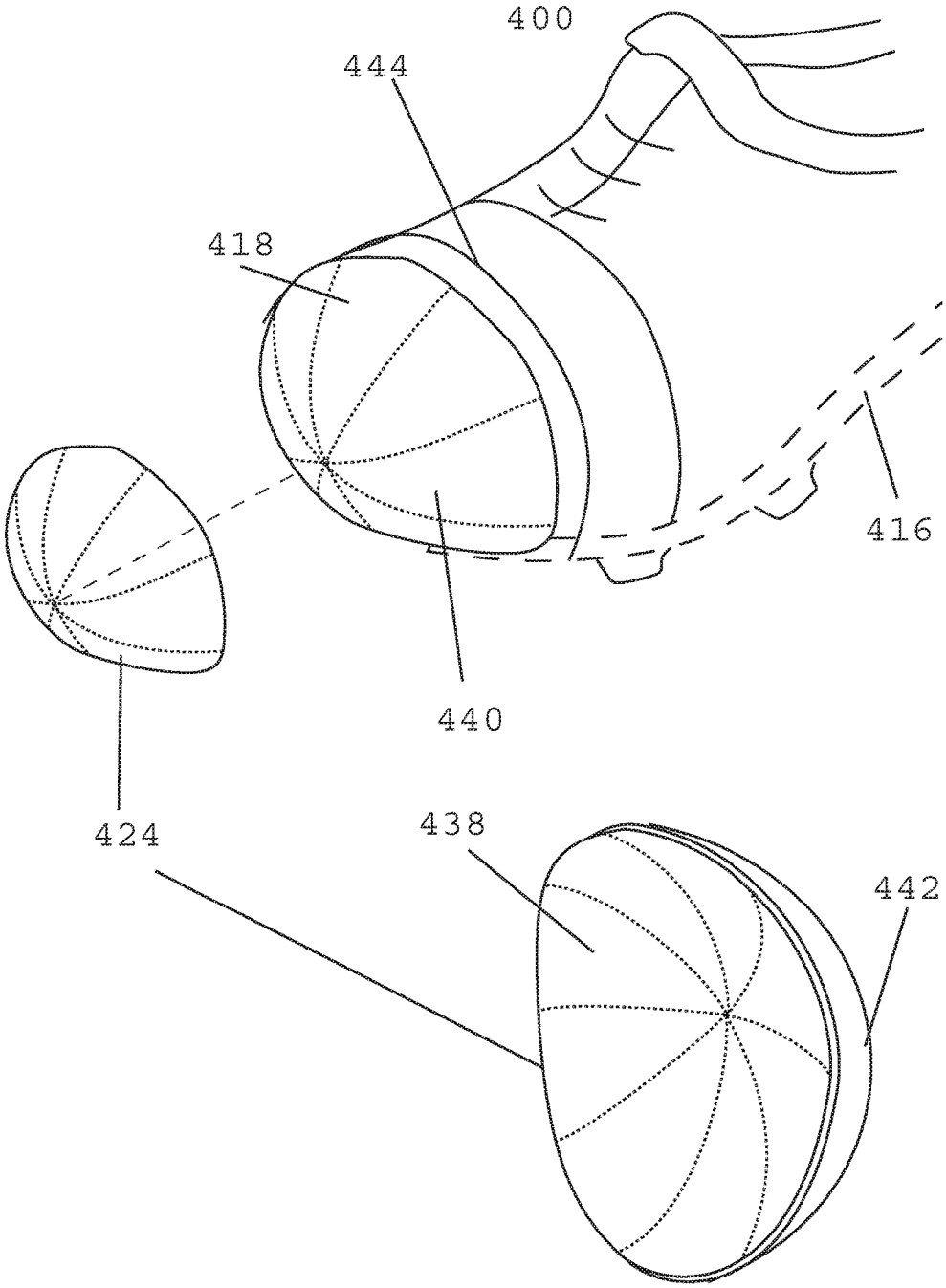
FIG. 5 shows another exemplary aspect where mechanical movement in more directions is possible compared to FIG. 4

Referring now to FIG. 5 which shows another embodiment whereby a proportion of change of shape in the flexible toe cap of article of footwear 400 may be effected by mechanical movement not limited by the directions of the slots shown in FIG. 4. Sole section 416 may physically extend upward beyond the area of the toes of a wearer and become fixed concave section 418 with no slots. Concave section 418 provides a generally hemispherical, or similar, fixed end to article of footwear 400. Fixed concave section 418 may also be rigid enough to protect the toes of a wearer during a kick. Fixed concave section 418 may be made of a type of plastic or rubberized plastic or other similar semi-rigid material and may be molded as part of sole section 416. Sections 416 and 418 may be connected to the upper components of article 400 by means such as adhesion or stitching. Moveable section 424 also provides a generally hemispherical, or similar moveable component, with a similar radius to concave section 418, that tessellates with fixed section 418. The lower picture in FIG. 5 shows moveable section 424 from a different angle for easier viewing of internal surfaces. Moveable section 424 may be made of rubber, synthetic rubber, rubberized plastic, an elastomer or other similar material. Surfaces 438 and 440 of sections 424 and 418 may be covered with a low friction coating such as Teflon so that when a ball is kicked with a glancing kick, the reaction force from such ball may move section 424 so as to fill in a dimple on such ball that was created by the force of the kick. Cover section 442, attached to section 424 may be made of a deformable material such as rubber so as to more perfectly fill any such dimple. The thickness of moveable section 424 and the attached section 442 may vary from two millimeters up to twenty-five millimeters or more. Moveable section 424 may be attached to the remainder of article of footwear 400 at points 444 which extend uniformly around article 400 including sole section 416. Such attachment at points 444 may be by adhesion, stitching or other means known to those familiar in the art. Broken lines on section 424 are provided for illustrative purposes to convey the shape of section 424 and do not imply mechanical features. Attachment points 444 may be implemented as far back as the tarsometatarsal joint of a wearer.

Figure 6:
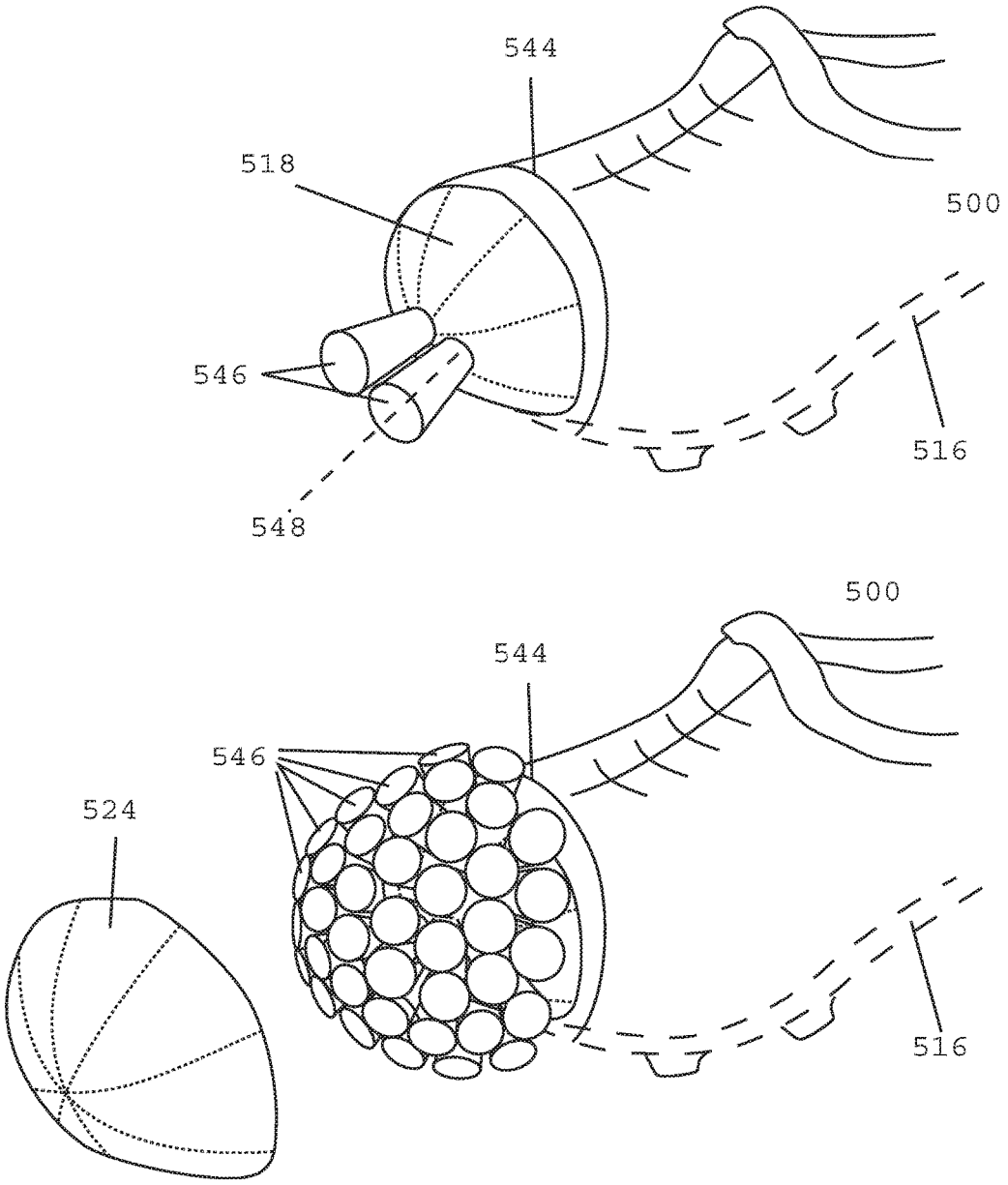
FIG. 6 shows another exemplary aspect where protrusions capable of bending are part of the flexible toe cap of an article of footwear

Referring now to FIG. 6 which shows another embodiment where the design focus is on enhancing lateral movement, however longitudinal deformation is also possible. Article of footwear 500, where sole section 516 may be attached at the toe end into a hemispherical extension 518 providing protection to the toes of a kicker. Sections 516 and 518 may be made from materials such as rubberized plastics, plastics or other material commonly used in the manufacture of a sole of a sports shoe. Sections 516 and 518 may be connected to the upper components of article 500 by means such as adhesion or stitching. Exterior moveable section 524 may wrap over the exterior end of article 500 and connect at points 544 via adhesion, stitching or other means. Hemispherical sole extension 518 may be connected to a number of generally conical shaped protrusions 546, such connection may be effected by adhesion, molding as a single unit or other means. In the upper half of FIG. 6 only two conical protrusions 546 are shown for illustrative purposes. The lower half of FIG. 6 shows a more realistic configuration. Such conical protrusions 546 may be made of materials that are able to be bent laterally and may return back to their original shape quickly. Examples of materials suitable to be used for protrusions 546 include, but are not limited to, natural rubber, synthetic rubbers, certain plastics and elastomers. Conical protrusions 546 are shaped such that upon a force being applied to them, such protrusions may deform much less along their axis 548 and more along directions orthogonal to axis 548, that is, bend side to side more than compress along their axis. Protrusions 546 may or may not be covered by optional flexible skin 524 which, if used, may be stretched and attach at points 544 on article 500 by stitching, adhesion or other means. Points 544 may be located as shown here or as far back as the tarsometatarsal join of a wearer.

Figure 7:
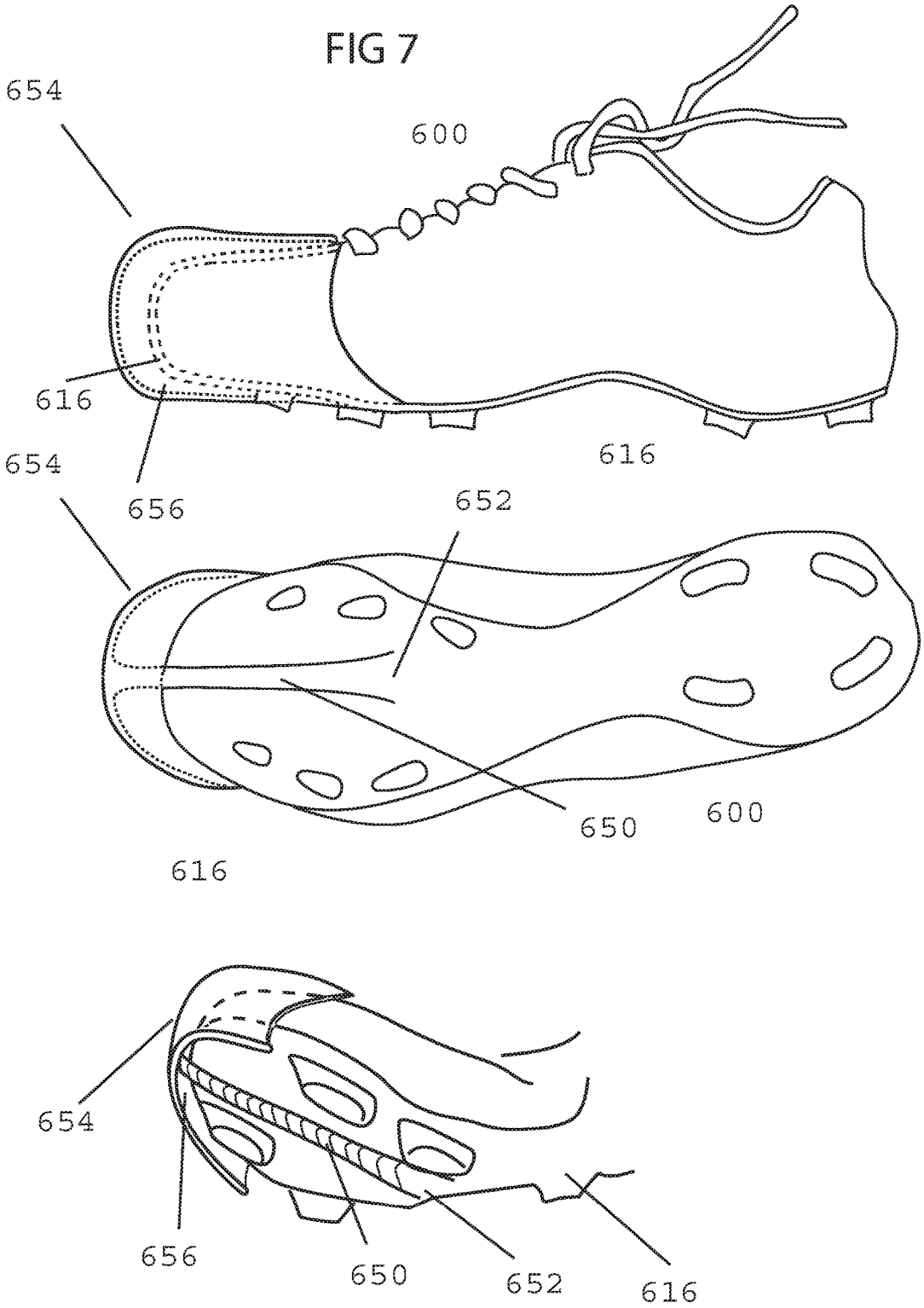
FIG. 7 shows another exemplary aspect where a flexible strut is employed

Referring now to FIG. 7, which shows an embodiment, article of footwear 600 where sole 616 has attached or molded to it a flexible strut 650 attached at a point 652 which is far enough toward the heel of article 600 such that the upward curvature of sole 616 provides a gap between flexible strut 650 and the lower surface of toe end of sole 616. Flexible strut 650 is attached to or molded to moveable shield 654. Such attachment may be effected by means including but not limited to molding, adhesion and riveting. Flexible strut 650 may be made of steel, natural rubber, synthetic rubber, some type of plastic or elastomer or other similar materials. Moveable shield 654 may be made of natural rubber, synthetic rubber, plastic or some type of elastomer or other similar material. The gap 656 between the conventional toe end of article 600 and moveable shield 654 may be such that, upon kicking a ball as hard as possible, moveable shield 654 may not come into contact with the conventional toe end of article 600. Similarly, the diameter of flexible strut 650 may be specified such that flexible strut 650 generally resists pure longitudinal deformation but allows temporary movement in directions including leftward, rightward, upward and downward, such diameter being variable with the chosen construction material. Moveable shield 654 is not attached to the remainder of article 600 in order that it may move in the case when a kick occurs. Shield 654 may vary in width from about two millimeters to about three centimeters or so and may be constructed of a flexible material such as an elastomer or foam rubber allowing for longitudinal deformation of several centimeters.

Figure 8A:
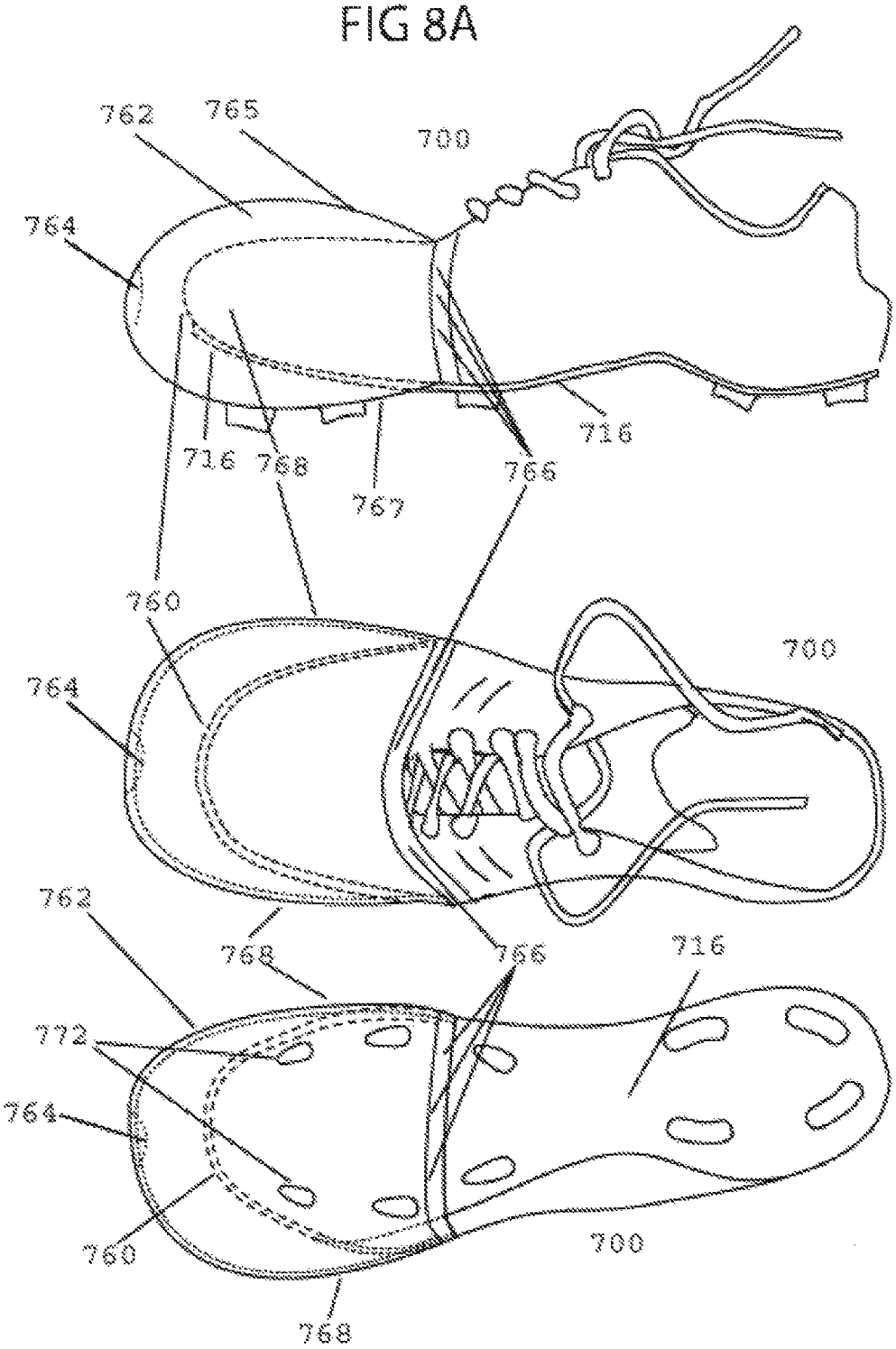
FIG. 8A shows another exemplary aspect employing a flexible toe cap as viewed from the side, top and below

Referring now to FIG. 8A which shows another embodiment of an article of sports footwear 700 comprising a sole 716 to which are attached cleats used to prevent slippage along a ground surface. Also attached to the sole is an upper part and a flexible toe cap 762 attached to the sole 716 and the upper part and configured for primary contact with an object while kicking such object. The flexible toe cap 762 is hollow and made from materials such as natural or synthetic rubber or an elastomer. The flexible toe cap 762 is attached to the sole 716 and the upper part in a connection ring 766 that resides at or near to a tarsometatarsal joint of a wearer. The flexible toe cap 762 is otherwise unattached to the remainder of the article of footwear. The flexible toe cap 762 may extend longitudinally forward of the toes of a wearer by a distance of at least two centimeters. Flexible toe cap 762 may have attached cleats used to prevent slippage along a ground surface. Except when the foot is planted to the ground, flexible toe cap 762 makes no contact with sole 716 except at the connection ring 766 yet is flexible enough then, when the foot of a wearer is pressed to the ground flexible toe cap 762 presses on sole 716.

The flexible toe cap 762 may be made of materials such as natural or synthetic rubber such that a 5 centimeter diameter vertical surface circle 764 that is most longitudinally forward on the flexible toe cap is configured to be able to move laterally with respect to a central axis of the footwear by more than 2 centimeters in a horizontal lateral direction in response to a horizontal lateral force of about 50 Newtons or more. This force could be a typical shearing force in the case of a hard kick by an experienced adult soccer player who is attempting to apply spin to a ball.

Figure 8B:
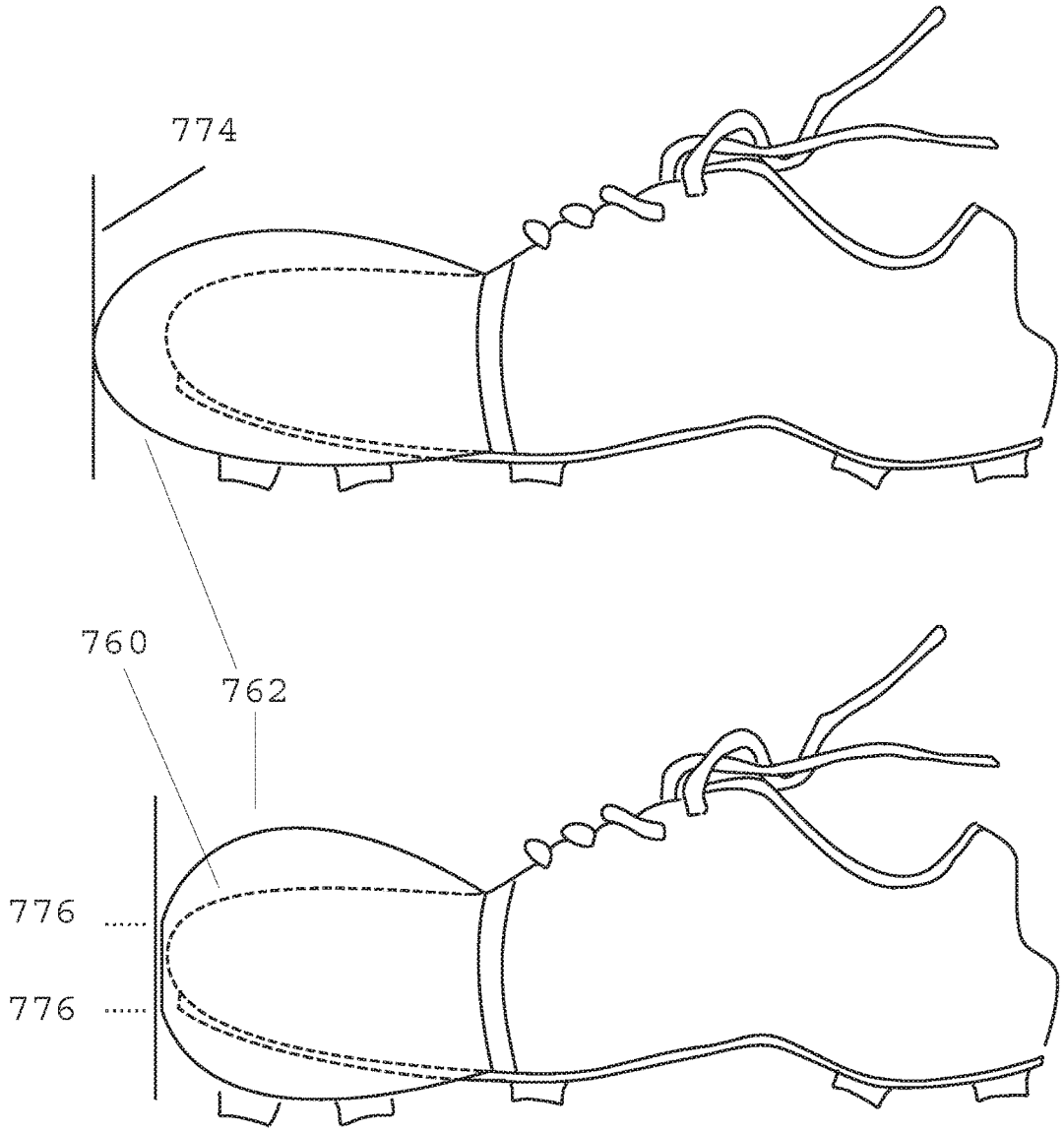
FIG. 8B shows a flat plane pressed against a flexible toe cap and sports shoe

This embodiment of the article of sports footwear 700 has a flexible toe cap 762 that is substantially rounded in each direction forward of its attachment points including at the top 765 and bottom 767. The flexible toe cap is adapted to be rounded at the bottom so that parts of the flexible toe cap slope downward longitudinally toward the front of the sports shoe when the sports shoe is viewed from a side as shown in FIGS. 8A & 8B. The most forward point of the flexible toe cap 762 is free to move via elastic like means, longitudinally as measured parallel to a front section of the sole and toward a heel of the article of footwear by a distance of at least about 2 centimeters or more as measured from a point where a tarsometatarsal joint of a wearer touches the sole portion of connection ring 766, as a result of a longitudinal force of 250 Newtons applied from a vertical plane pressing longitudinally upon the front of the horizontal flexible toe cap 762 oriented orthogonally to the vertical plane. A longitudinal force of 250 Newtons may be common for a hard kick of a sports ball by an adult kicker.

As previously described, conventional shoe toe cap 760 and sole 716 are encased by flexible toe cap 762. Flexible toe cap 762 is hollow and may be constructed of natural rubber, synthetic rubber, some type of plastic or elastomer or other similar material. Flexible toe cap 762 may be attached to the upper body of article of footwear 700 at connection ring 766 via adhesive means or by stitching or other means known to those familiar in the art. Connection ring 766 may be placed at or near the tarsometatarsal joint of the foot of the wearer. There may be no other points of contact between flexible toe cap 762 and sole 716. The thickness of membrane of flexible toe cap 762 may be variable but may provide enough rigidity to prevent contact with conventional toe end 760 during a kick. At points inside circular area 764 the thickness of membrane of flexible toe cap 762 may be greater than that in some other areas of flexible toe cap 762. This increased thickness may prevent excessive deformation at points inside circle 764 upon initial contact of a convex surface of a ball during a kick. Sides 768 of flexible toe cap 762 may be created curved and with a thin enough membrane so that, upon a strong longitudinal reaction force from a kicked ball acting upon flexible toe cap 762, sides 768 may bend outward away from conventional shoe toe cap 760 thereby increasing the radius of flexible toe cap 762 closer to the size of the radius of a dimple created in a kicked ball. The most longitudinally forward cleats or studs 772 may be molded to the remainder of article 762.

Referring now to FIG. 8B which illustrates a scenario where a flexible toe cap 762 is able, by means of the elasticity of this flexible toe cap, to selectively change shape upon the application of a longitudinal force of 250 Newtons such that the area of contact between a vertical plane 774 providing such force and the flexible toe cap 762 is at least 80 square centimeters. Assuming a circular contact area, this equates to an approximate 10 centimeter diameter circle of contact with a rigid vertical plane, that is, points 776 are approximately 10 centimeters or more apart. In the upper illustration the area of contact between a vertical plane and the flexible toe cap 762, when these just touch, is negligible due to the rounded nature of the flexible toe cap touching a flat plane. The deformation to provide at least 80 square centimeters of contact possible due to the fact that the cap is unconstrained forward of its attachment point and is advantageous to a controlled kick against the plane. During application of such 250 Newton or greater force, the maximum radius of the flexible toe cap 762 may increase by at least 10 percent as shown due to the curvature of the flexible toe cap which supports deformation laterally as well as longitudinally due to the increased bend created by the push of such force.

Figure 9A:
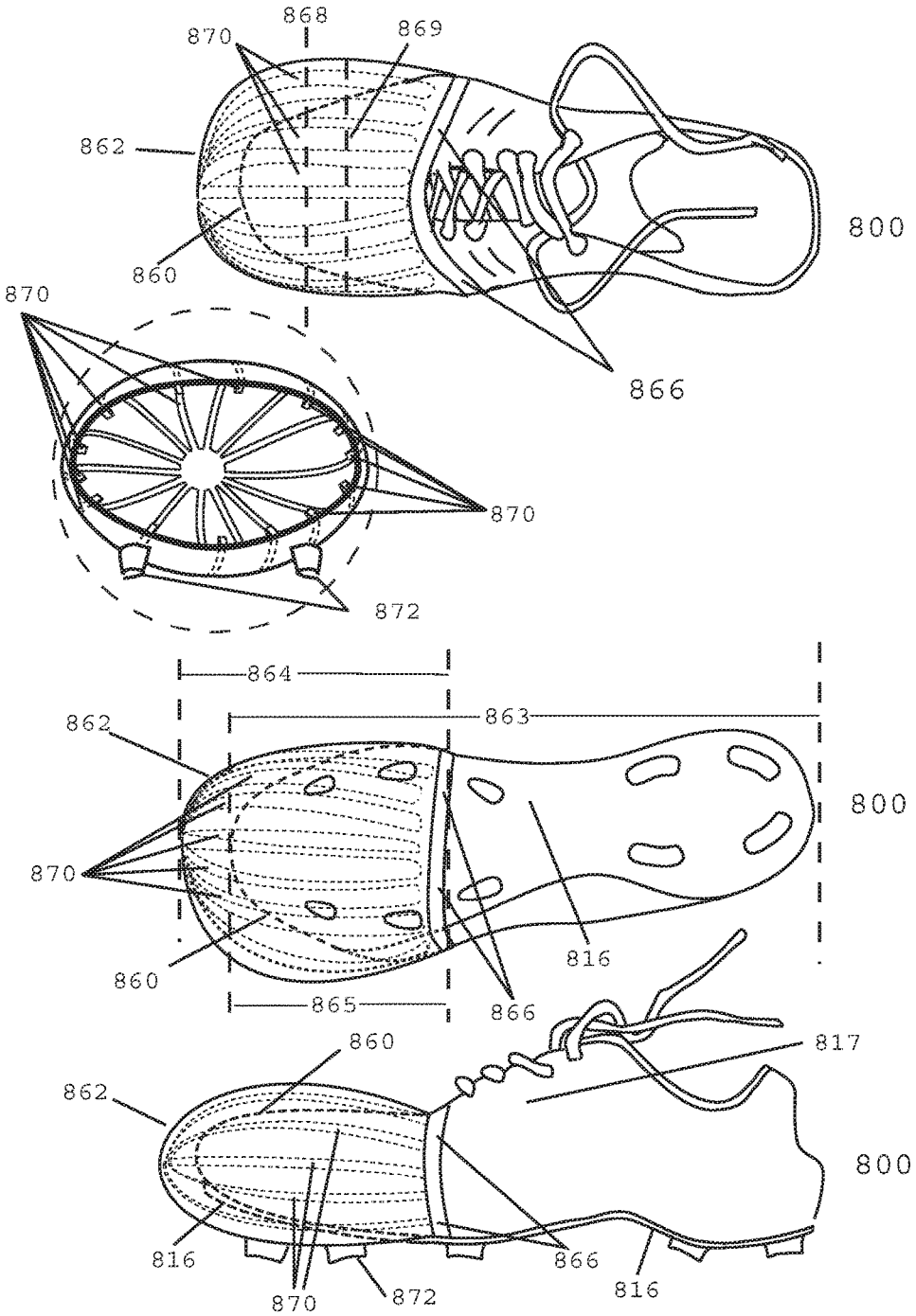
FIG. 9A shows another exemplary aspect similar to that shown in FIG. 8A but with longitudinal strengthening struts added

Referring now to FIG. 9A, which shows an embodiment where an article of footwear 800 is comprised of a sole 816 comprising an upper surface and a lower surface, the lower surface configured for contact with a ground surface. Article of footwear 800 could be considered to be a conventional article of footwear with a conventional sole 816 and a conventional toe end 860 both wrapped with a flexible toe cap 862. Flexible toe cap 862 may be made of rubber, synthetic rubber, a type of elastomer or other similar flexible material. Flexible toe cap 862 may be attached to article of footwear 800 at points 866 and is otherwise unattached to both the sole 816 and the conventional toe end 860. Methods of possible attachment include but are not limited to adhesion or stitching. FIG. 9A is broken into four sections. The top picture depicts a view from above of article of footwear 800. The picture second from top shows, inside the broken line circle, a vertical cross section of article of footwear 800 taken at imaginary line 868. The third from top picture depicts a view of article of footwear 800 from below, and the lowest picture depicts a view from the medial side. Longitudinal strengthening struts 870 may be attached to or molded with the inner surface of flexible toe cap 862 and radiate from the most forward point in flexible toe cap 862 toward the areas of attachment of flexible toe cap 862 and the remainder of article of footwear 800. Any such attachment may be effected by adhesion or stitching or other means known to those familiar with the art. In some cases longitudinal strengthening struts 870 are illustrated by broken lines since they are covered on the outside by the outer surface of flexible toe cap 862. Longitudinal strengthening struts 870 may be made from natural rubber, synthetic rubber, some type of plastic or elastomer or other similar material. In other cases longitudinal strengthening struts 870 may be made of steel whereby such thin steel struts may be wrapped in the material that makes up flexible toe cap 862. Flexible toe cap 862 may be made from natural rubber, synthetic rubber, some type of plastic or elastomer or other similar material. Cleats 872 used to provide grip with the ground surface may be attached to or molded with the underside of flexible toe cap 872. Longitudinal strengthening struts 870 partially resist longitudinal movement but allow temporary lateral movement when a shearing force from a kicked ball is applied to them. Flexible toe cap 862 may be flexible enough to move upward when a wearer presses his or her foot upon the ground.

Article 800 also comprises an upper portion 817 attached to the sole 816 and cooperating with the sole to define an interior 860 for receiving a foot of a wearer. Article 800 also comprises a flexible toe cap 862 attached to each of the sole 816 and the upper part 817 along a perimeter, the flexible toe cap 862 defining a front portion wherein the sole 816 is made of a first material which may be a type of plastic or rubber or other elastomeric material and the upper portion 817 is made of a second material which may be one or more of leather and vinyl and the flexible toe cap 862 is made of a third, elastomeric, material that is different from the first material and the second material and is more flexible than the first material. The sole 816 defines a first length 863. The flexible toe cap 862 defines a second length 864. The first length 863 is longer than the second length 864 by a ratio of at least about 2 to about 1 and the flexible toe cap 862 is unconnected to the sole at any point forward of the tarsometatarsal joint of a wearer. In addition, the flexible toe cap 862 is rounded in each direction yet flexible enough so that when a wearer plants a foot on the ground the lower portion of the flexible toe cap is pushed against the sole 816 or against the foot of a wearer. The perimeter of the flexible toe cap 862 resides in a substantially vertical plane. The sole 816 extends into the flexible toe cap not more than 90 percent of an overall length 864 of the flexible toe cap 862 as illustrated by the fact length 865 is not more than 90 percent of length 864. The first material, that is, the material that the sole is made of, has a first stiffness rating and the third material, that is, the material the flexible toe cap 862 is made of, has a second stiffness rating, and the first stiffness rating is at least twice the second stiffness rating. The sole 816 and upper portion cooperate to form a conventional closed toe end 860. The flexible toe cap 862 is spaced from a distal end of the closed toe end 860. The flexible toe cap 862 may be spaced from the distal end of the closed toe end 860 by about 10% or more of a radius 869 of the flexible toe cap 862.

Figure 9B:
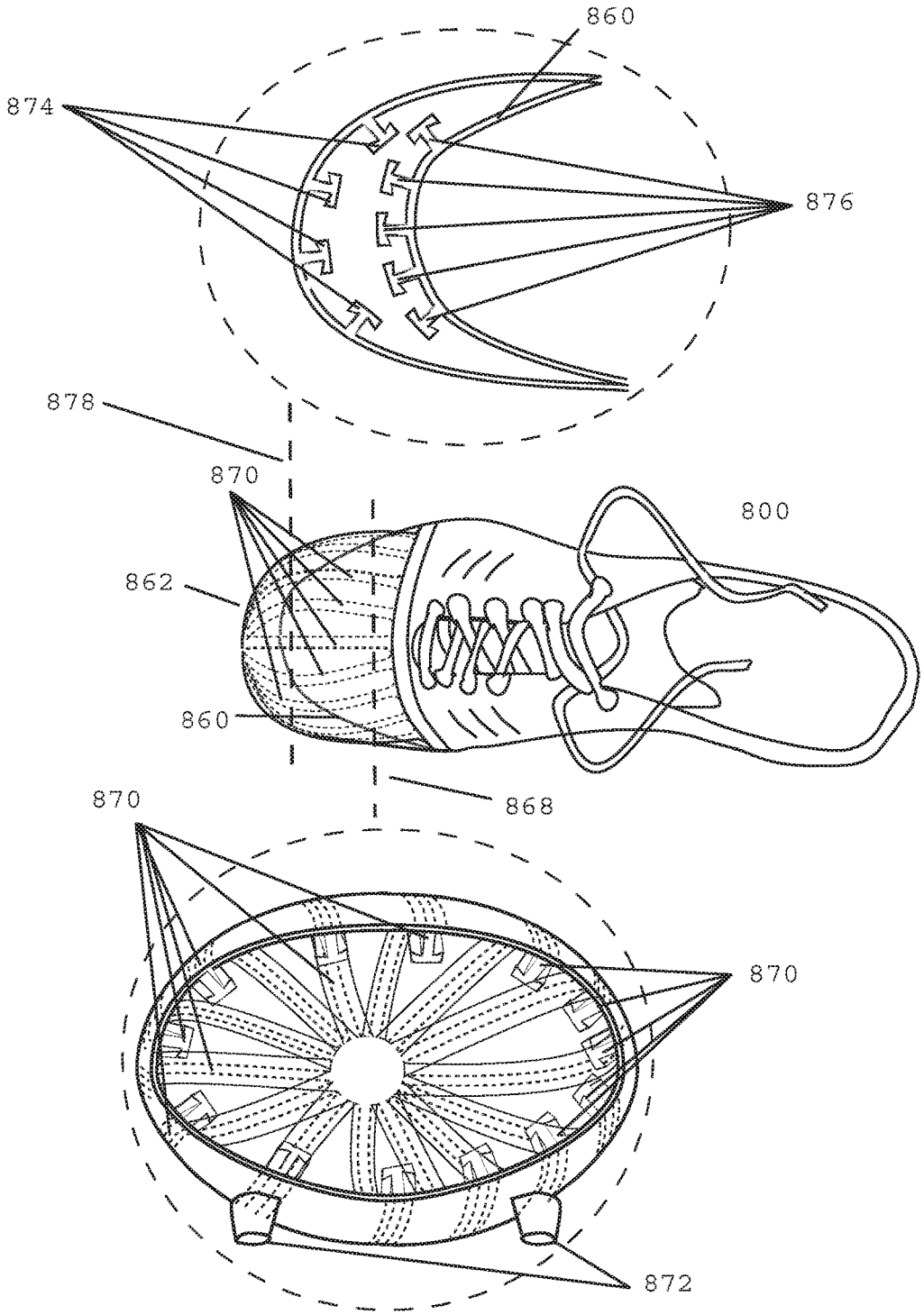
FIG. 9B shows another exemplary aspect similar to that shown in FIG. 9A but with T shaped struts allowing a wearer to lock the article prior to a kick

Referring now to FIG. 9B which shows a derivation of the embodiment shown in FIG. 9A whereby longitudinal strengthening struts 870 are fitted with T shaped latches 874. Conventional toe end 860 may also be augmented with similar struts with T shaped latches 876 which may only be implemented in a horizontal band close to the horizontal plane at the center of the midpoint vertically of article 862. Cross section 878 depicts a vertical cross section of such toe section of article 800 and is shown as the top drawing in FIG. 9B. Both sets of T shaped latches may be implemented by a molding process whereby such latches may be molded with the rest of their respective struts. Cleats or studs 872 may be attached to the base of section 862 by molding or other means. FIG. 9B provides the capability to store potential energy for release in a medial to lateral or lateral to medial direction. Energy may be stored when a kicker pushes the toe end of his or her foot against the ground on an angle such that articles 874 latch onto articles 876. This causes lateral stretch on articles 874 and they then latch to articles 876 while the exterior surface of flexible toe cap 862 is laterally stretched. Such energy may be released upon a kick by the force of the kick separating articles 874 and 876. It should be clear to those familiar in the art that storage of potential energy for release in a vertical direction may be implemented with a thin vertical band of T shaped struts on conventional toe end 860 rather than the horizontal band just described. Such T shaped struts may lock to similarly oriented T shapes appointed to struts on flexible toe cap 862. Cross section 868 is illustrated in the lower of the three drawings in FIG. 9B.

Figure 9C:
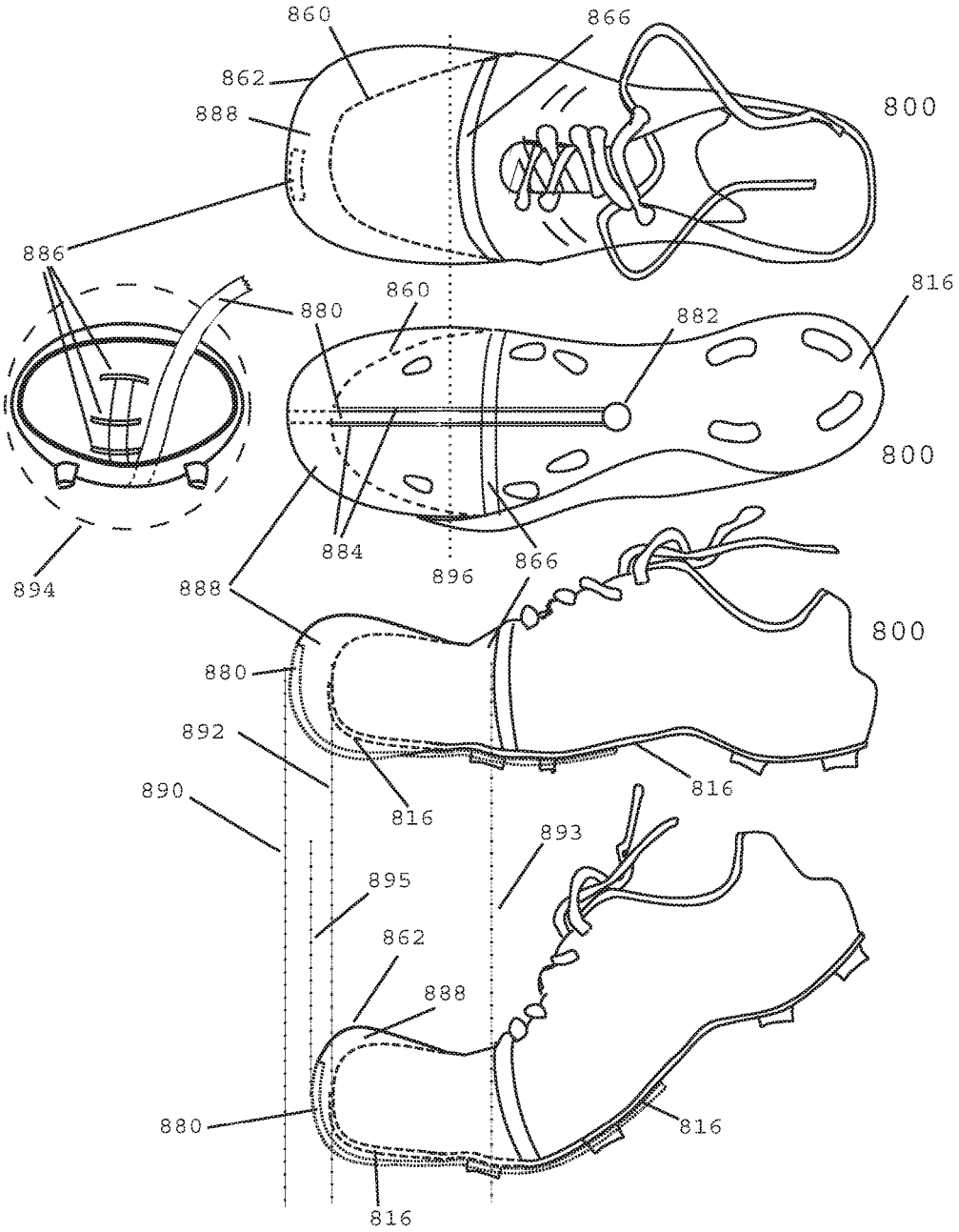
FIG. 9C shows a strap and memory foam that transiently shorten the article of footwear during a stride

Referring now to FIG. 9C which shows an embodiment similar to that shown in FIG. 9A minus the strengthening struts, enhanced however to provide a means to transiently shorten the length of flexible toe cap 862 in order to prevent a wearer from tripping as a result of the extra shoe length contributed by flexible toe cap 862. The sole 816 and upper portion cooperate to form a closed toe end 860. A portion of material 888 is fastened between the flexible toe cap 862 and the closed toe end 860. Upon bending of a wearer's foot during running, the longitudinal length of the flexible toe cap decreases by at least 10 percent as illustrated by the gap between planes 893 and 890 compared to the gap between planes 893 and 895.

Upon straightening of the foot during running, the time taken for the flexible toe cap to return to a steady state position is extended to about one half of a second due to the slow-to-decompress nature of the portion of material fastened between the flexible toe cap and the closed toe end.

Strap 880 may be made from a material that does not stretch longitudinally but is able to move in other directions, like a typical strap. Such material may be leather, plastic, vinyl or other similar materials. Strap 880 is attached to sole 816 at attachment point 882 which is located at a point longitudinally back from flexible toe cap 862 and toward the heel of article 800. Attachment of strap 880 at point 882 may be achieved using stitching, adhesives or other means. Strap 880 may run longitudinally forward from attachment point 882 in a slot 884 molded or cut into sole 816. FIG. 9C includes view 894 which is intended to represent a vertical cross section of article 800 at plane 896. At attachment point 866 where the flexible toe cap 862 attaches to sole 816, Strap 880 is engulfed by flexible toe cap 862 and enters the inside of flexible toe cap 862 via slot 884. Strap 880 is attached to the inside surface of flexible toe cap 862 by attachment items 886 which are stitched, glued or otherwise attached to both flexible toe cap 862 and to strap 880. The gap between flexible toe cap 862 and conventional toe end 860 may be filled with a memory material 888 that is able to compress quickly under force and yet return to a normal position more slowly once a compressive force is removed. Such memory material 888 may be a form of viscoelastic polyurethane foam, otherwise known as memory foam, or an equivalent. Memory material 888 may be fastened to both conventional toe end 860 and to flexible toe cap 862 via adhesives or other means. The operation of this exemplary embodiment is described later in the operation section.

Figure 9D:
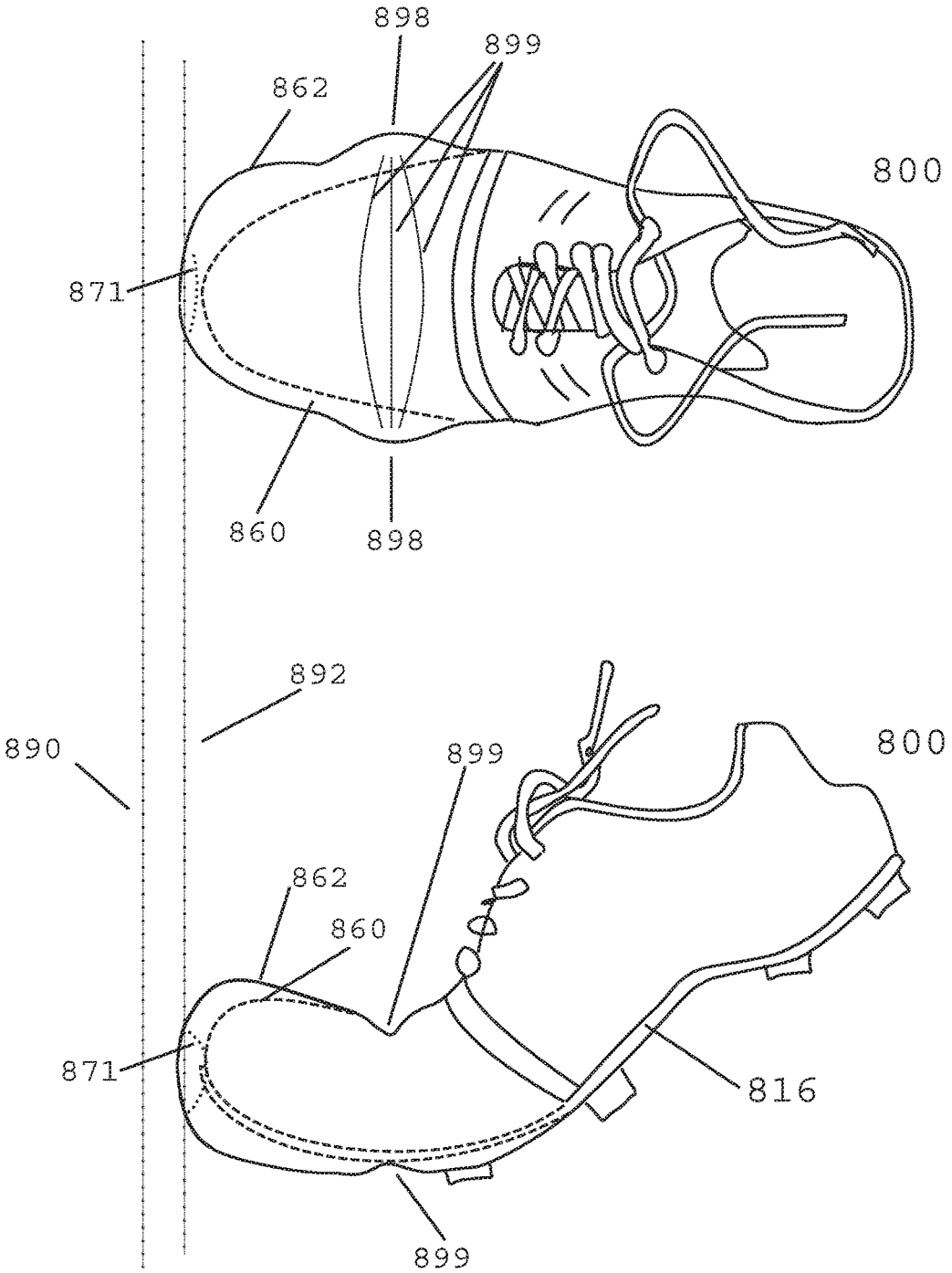
FIG. 9D shows a controlled crease that that transiently shortens the article of footwear during a stride

Referring now to FIG. 9D The sole 816 and upper portion of the article of sports footwear 800 cooperate to form a conventional closed toe end 860. A portion of material 888 is fastened between and to the flexible toe cap and the closed toe end. Such material 888 may be a type of memory foam or other material that is slow to decompress after a force is removed from it. Upon bending of a wearer's foot during running, the longitudinal length of the flexible toe cap decreases by at least 10 percent; and, upon straightening of the foot during running, the time taken for the flexible toe cap to return to a steady state position is extended to about one half of a second due to the slow-to-decompress nature of the portion of material fastened between the flexible toe cap and the closed toe end.

FIG. 9D shows the same shortening effect of the flexible toe cap 862 as shown in FIG. 9C, however this time the effect is achieved by thinning the flexible toe cap in a horizontal plane at or near to the tarsometatarsal joint such that when a foot bends at this joint, protrusions 898 are caused by the controlled creases 899 that appear on article 800. Creases 899 and protrusions 898 have the effect of pulling the longitudinal end of flexible toe cap 862 closer to conventional toe end 860 when the foot is bent at its maximum during running, that is at the moment shown in the lower picture in FIG. 9D. Such creases and protrusions change the outer shape of flexible toe cap 862 from a smooth curve to a series of hills and valleys and this extra curvature pulls the end of flexible toe cap 862 longitudinally toward the heel. This contrasts with a conventional article of sports footwear where a semi rigid sole prevents creases developing on the underside of an article of footwear. Just as in the prior figure, the gap between flexible toe cap 862 and conventional toe end 860 may be filled with a memory material 888 that is able to compress quickly under force and yet return to a normal position more slowly once a compressive force is removed. Such memory material 888 may be a form of viscoelastic polyurethane foam, otherwise known as memory foam, or an equivalent. Memory material 888 may be fastened to both conventional toe end 860 and to flexible toe cap 862 via adhesives or other means. Such memory material may slow the re-expansion of flexible toe cap 862 from position 892 to position 890.

Figure 9E:
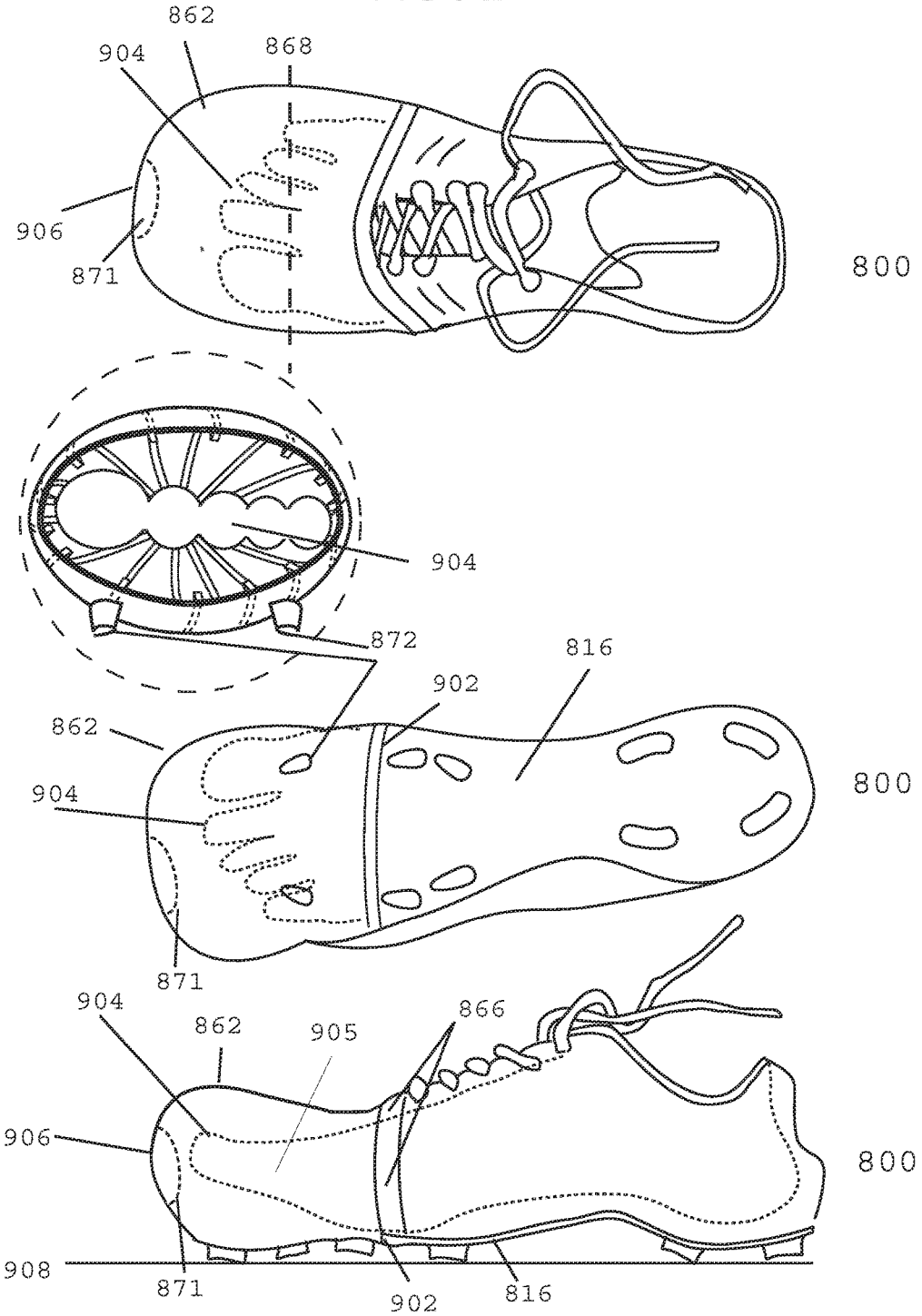
FIG. 9E shows an embodiment where the sole terminates where the flexible toe cap begins

Referring now to FIG. 9E which shows an embodiment where sole 816 terminates at line 902. The article of sports footwear 800, comprises an upper part, a sole 816, and a flexible toe cap 862 attached to the sole 816 and attached to the upper part and configured for primary contact with an object while kicking such object, the flexible toe cap 862 comprising a base with cleats attached to the base of the flexible toe cap and to the sole and configured to prevent slippage along a ground surface. The flexible toe cap 862 is hollow and made from materials such as natural or synthetic rubber. The flexible toe cap 862 is attached to the upper part in a vertical plane that resides proximate to a tarsometatarsal joint of a wearer. The flexible toe cap 862 is attached to the sole 816 at a vertical plane that resides at or near to a tarsometatarsal joint of a wearer. The forwardmost longitudinal boundary 902 of the sole 816 is in the vertical plane that resides at or near to a tarsometatarsal joint of a wearer. The flexible toe cap 862 is substantially rounded in each direction such that the toes 904 of a wearer are unsupported by one of the flexible toe cap 862 and sole 816 except when the foot 905 of the wearer is pressed against the ground surface.

In addition, in this embodiment a forwardmost point 906 of the flexible toe cap 862 is free to move elasticly, in a longitudinal direction toward a heel of the article of footwear, by a distance of at least about 2 centimeters or more, as measured from a line 902 where a tarsometatarsal joint of a wearer touches the sole, in response to a longitudinal force of 250 Newtons applied from a vertical plane pressing longitudinally upon the front of a horizontal flexible toe cap 862 oriented orthogonally to the vertical plane. In this embodiment, an entirety of the flexible toe cap 862 that is contained in a 5 centimeter diameter vertical surface circle 871 that is most longitudinally forward is configured to move laterally with respect to a central axis of the footwear by more than 2 centimeters in a horizontal lateral direction in response to a horizontal lateral force of about 50 Newtons or more.

In the embodiment described in FIG. 9E when the foot of the wearer is lifted above the ground, the area forward of the tarsometatarsal joint of the wearer is unsupported due to the fact that the sole 816 terminates at such joint and also due to the fact that the flexible toe cap 862 may be curved downward from the point of attachment to the sole to a point forward of the end of the toes 904. Additionally the flexible toe cap 862 of the article of sports footwear 800 has a mechanical stiffness that prevents contact between itself and toes of a wearer during the application of the longitudinal force of 250 Newtons. This force could be a typical force in a hard kick by an experienced adult soccer player. This longitudinal movement, and change of diameter, of flexible toe cap 862 toward such toes 904 during a kick is useful in that it increases the area of contact with a kicked ball and also allows flexible toe cap 862 to move laterally to stretch such flexible toe cap 862 such that it rebounds back to a resting position while still in contact with a kicked ball, hence adding to any spin that might be imparted on such ball.

While a variety of embodiments have been described, this description is intended to be exemplary, rather than limiting and it will be apparent to those of ordinary skill in the art that other implementations and embodiments are possible that are within this scope. As such, embodiments are not to be restricted except in light of the attached claims and their equivalents. Various modifications may be made within the scope of the attached claims.

Other methods, systems, advantages and features shall be apparent to one of typical skill in this art upon review of the following figures and detailed description. It is intended that all such additional methods, systems, advantages and features be included within this description and summary, be the scope, and be protected by the claims attached hereto.

In some embodiments, the surface material of the front of a flexible toe cap may be of a type providing high grip with a kicked ball. Such materials may include, but are not limited to, materials with a high coefficient of friction such as natural rubber, synthetic rubbers, plastics and elastomers.

In some embodiments, the surface material of the flexible toe cap may include, but is not limited to, micro gripping materials or nano gripping materials or technologies.

In some embodiments, the surface material of the flexible toe cap may include, but is not limited to, channels or other similar pathways that allow water & other liquids to be diverted away from both the surface of the flexible toe cap and a ball upon contact between both. In some embodiments, the force of the flexible toe cap acting upon a ball may squeeze said liquids through said channels or other pathways in order to maintain a relatively dry contact area between a kicked ball and the flexible toe cap in wet conditions.

In some embodiments, the surface of the flexible toe cap may be either made from or coated with water-repellent technologies.

In another aspect, the end piece of the footwear is made up of an elastic skin holding a gas whereby pneumatic effects occur such that a change shape in the end piece of the footwear occurs upon application of a force by the ball acting on the footwear due to movement and compression of gas, and such gas and elastic effects of the skin later returns the end piece of the footwear to the original position after the ball is kicked.

In each embodiment the change of shape or deformation of the end piece of the footwear that occurs when a kicker kicks another player is protective of the kicked player since the change of shape or deformation of the end piece increases the area of contact with the kicked player thereby diminishing the force per unit area applied.

Operation of these Embodiments

Figure 10A:
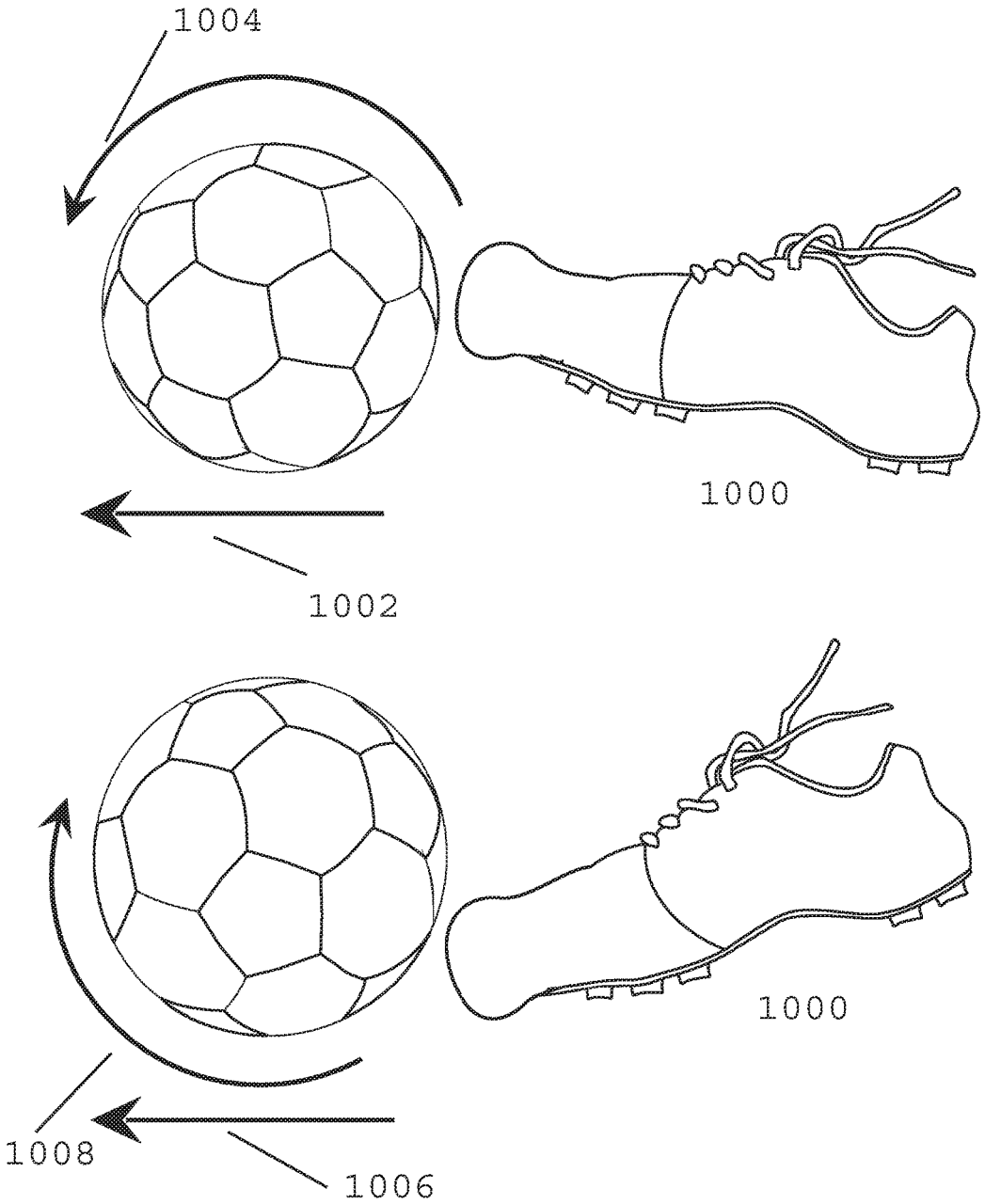
FIG. 10A shows an exemplary aspect imparting top spin and back spin to a ball

Referring now to FIG. 10A, showing a generic equivalent 1000 of any of the embodiments so far discussed. The term "top spin" as used throughout this detailed description and claims is intended to convey a ball rotation as shown as the configuration in the upper picture such that the axis of rotation of the ball is horizontal and orthogonal to the intended direction 1002 of the ball and the direction of such rotation is as shown in arrow 1004.

The term "back spin" as used throughout this description and claims is intended to convey a ball rotation, as shown in the lower picture such that the axis of rotation of the ball is horizontal and orthogonal to the intended direction 1006 of the ball and the direction of such rotation is as shown in arrow 1008.

Figure 10B:
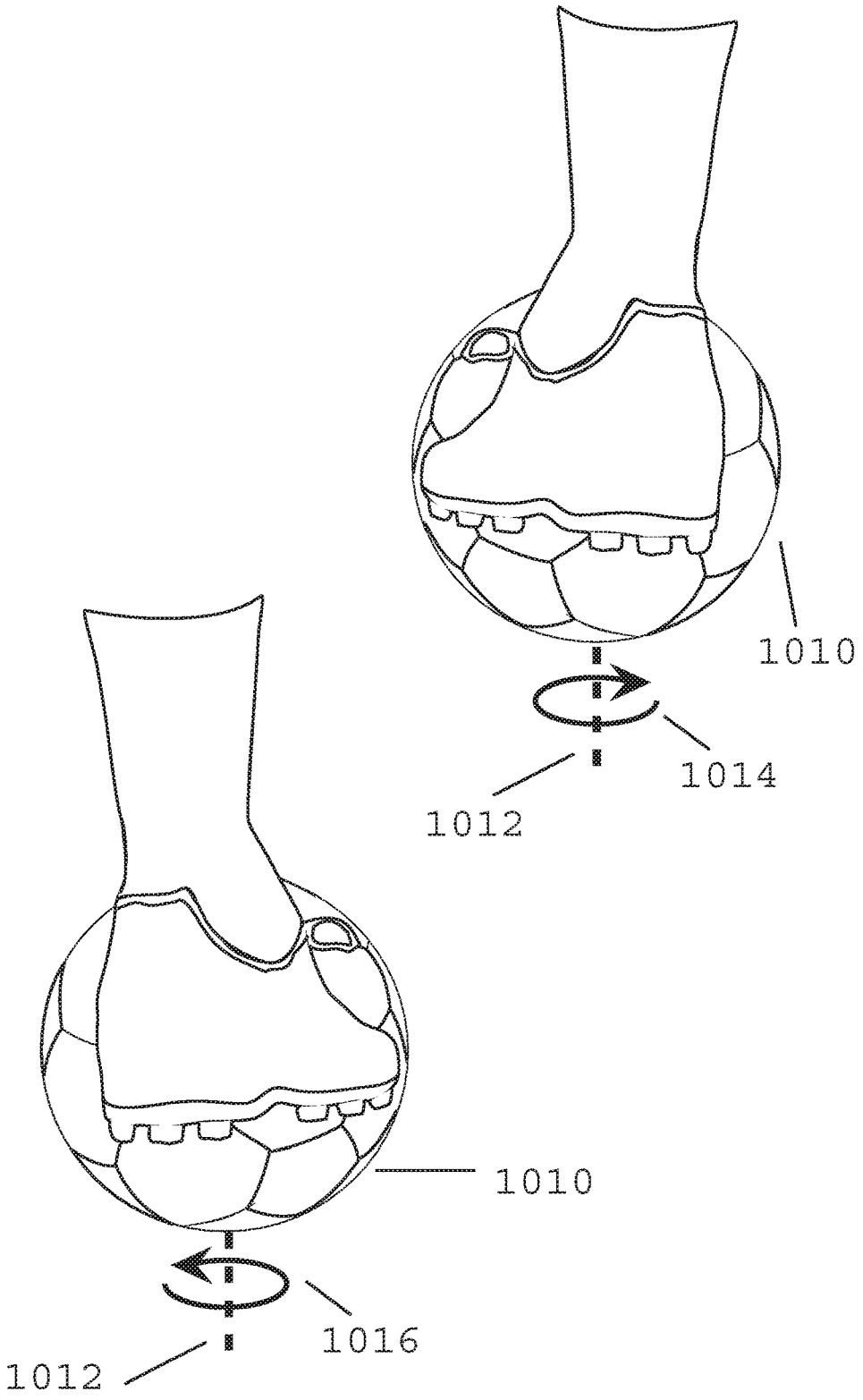
FIG. 10B shows an exemplary aspect imparting two directions of side spin to a ball

Referring now to FIG. 10B, the term "side spin" as used throughout this detailed description and claims is intended to convey a ball rotation such that the axis of rotation 1012 of the ball is vertical and orthogonal to the intended direction of the ball 1010 and the direction of such rotation is either left to right 1014 as shown in the upper picture or, alternately, right to left 1016 as shown in the lower picture.

Figure 11A:
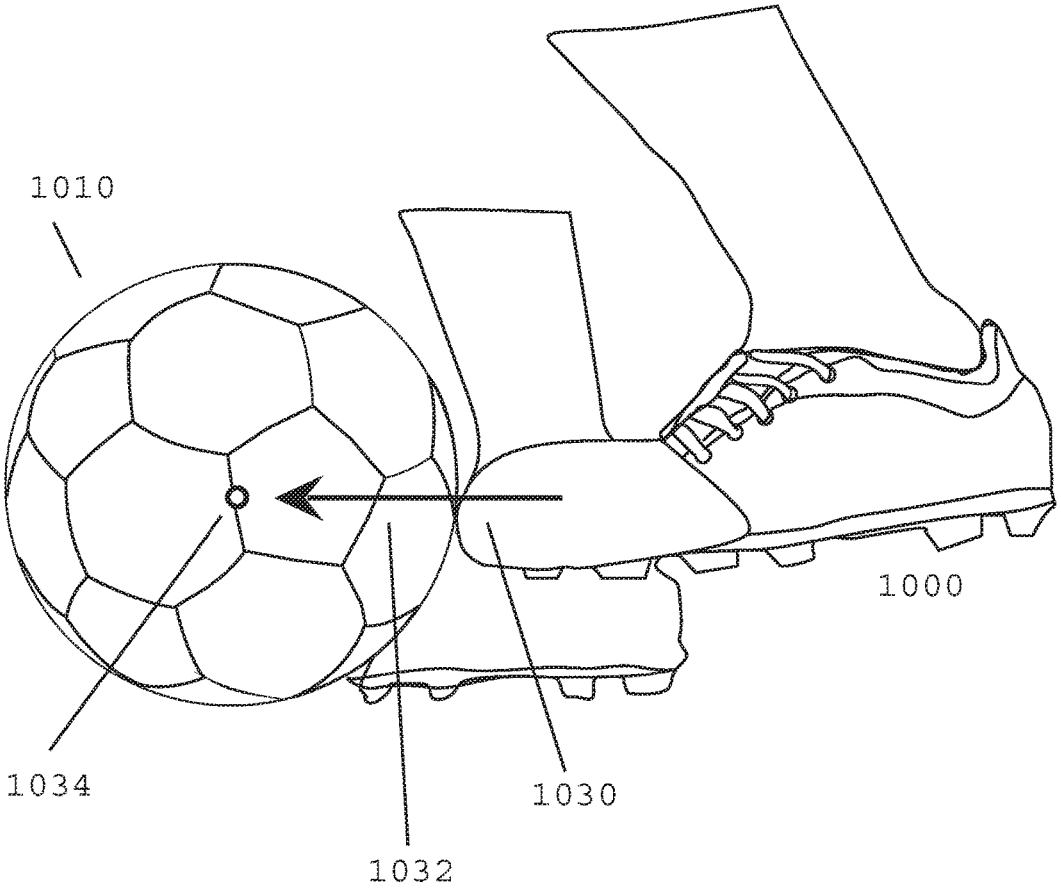
FIG. 11A shows impacting a ball at the toe end of the footwear

Referring now to FIG. 11A, consider a kick where the intention of the kicker is to kick a ball perfectly straight, not imparting spin of any kind via a kick where the majority of contact with ball 1010 is with flexible toe cap 1030. The predominant vector of movement 1032 of article of footwear 1000 and flexible toe cap 1030 may pass at or close to the point that was the center 1034 of ball 1010 when resting. The effect of such kick force may be to create a large concave dimple, not shown, on ball 1010. Since the vector of the kick was directed perfectly centrally to the center of ball 1010, flexible toe cap 1030 may remain physically connected to the central part of any large dimple created on ball 1010 during the time that there is contact between flexible toe cap 1030 and ball 1010. Ball 1010 may impart, on flexible toe cap 1030, a longitudinal reaction force which may change the shape of flexible toe cap 1030 almost uniformly in all directions thereby forming a new shape for flexible toe cap 1030 which may better tessellate with the large dimple in ball 1010 and may increase area of contact in directions, up, down, medially and laterally.

Figure 11B:
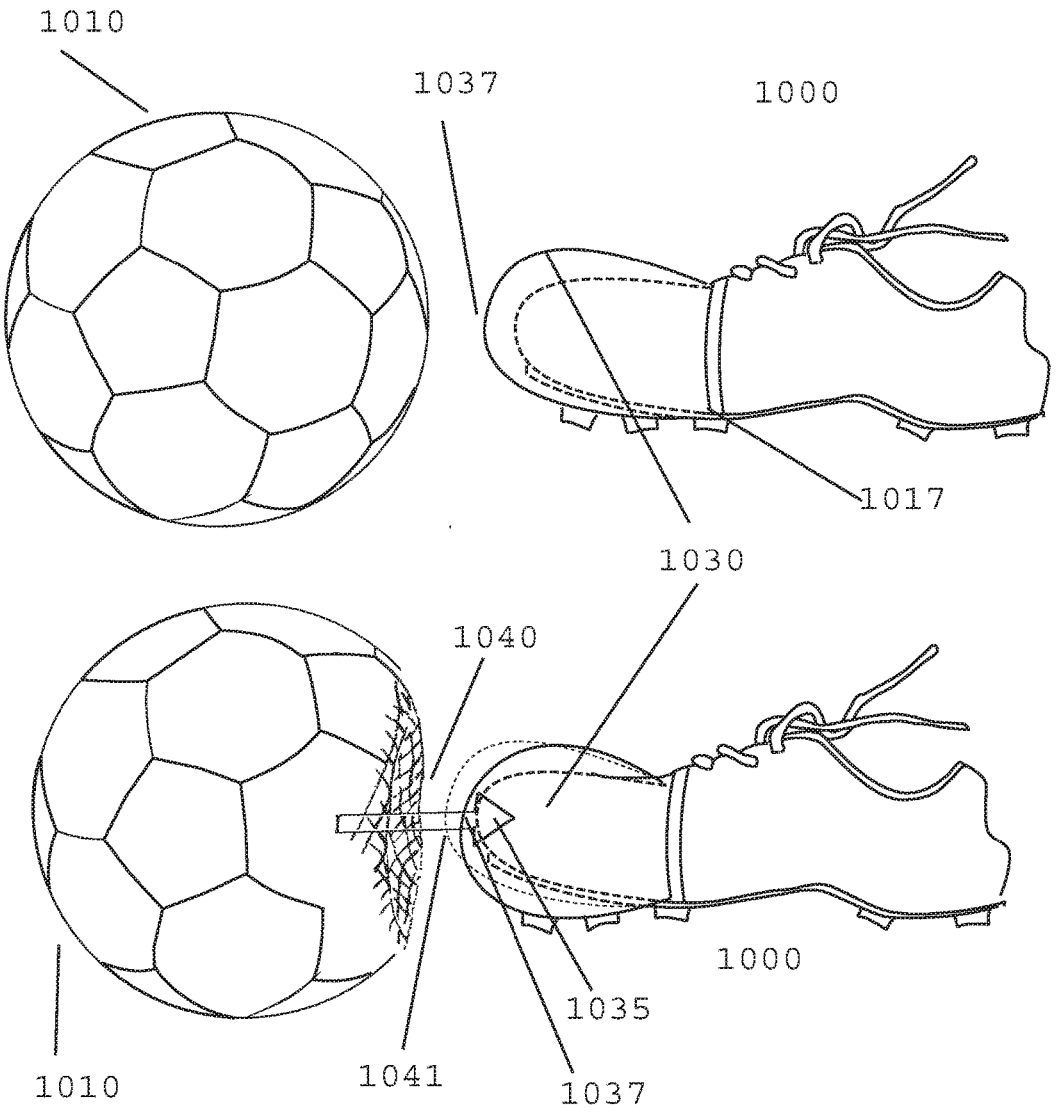
FIG. 11B shows the scenario from FIG. 11A expanded for clarity

Referring now to FIG. 11B which shows a flexible toe cap 1030 of article 1000 with ball 1010 moved to the left for illustrative purposes. The top picture illustrates an instance where there is no contact with a ball 1010 and the lower picture shows an instance where the point of maximum reaction force from a ball acting on flexible toe cap 1030 during a contact between flexible toe cap 1030 and a ball 1010, such ball moved to the left for illustrative purposes. The reaction force 1035 imparted by ball 1010 upon flexible toe cap 1030 may change the shape of flexible toe cap 1030 such that part of flexible toe cap 1030 moves into part or all of the transient dimple 1040 created on ball 1010 by the force of a kick.

In this and other embodiments a forwardmost point 1037 of the flexible toe cap 1030 is free to move elasticly, in a longitudinal direction toward a heel of the article of footwear, by a distance of at least about 2 centimeters or more, as measured from point 1017 where a tarsometatarsal joint of a wearer touches the sole, in response to a longitudinal force of 250 Newtons applied from a vertical plane pressing longitudinally upon the front of a horizontal flexible toe cap oriented orthogonally to the vertical plane. A longitudinal force of 250 Newtons is typical for a hard kick by an adult wearer. In the lower diagram this longitudinal deformation is represented by a change of position of point 1037 to the new position shown, compared to the same point on the upper diagram. This longitudinal change of direction is possible since flexible toe cap 1030 is hollow and curved and created with a material that is flexible enough to allow longitudinal deformation aided by lateral and vertical expansion of the sides of the flexible toe cap which is supported by the curved nature of the flexible toe cap.

One effect of such shape change in flexible toe cap 1030 around the area of the transiently-created dimple 1040 on ball 1010 is to increase the area of contact between flexible toe cap 1030 and ball 1010. As described in the descriptions of various embodiments, components of flexible toe cap 1030 are designed to "prefer" to move from side to side rather than to compress substantially longitudinally, so with a substantially longitudinal reaction force, components of flexible toe cap 1030 may move so that all but the very central pieces of flexible toe cap 1030 move away from the center of contact, thereby spreading flexible toe cap 1030 in directions upward, downward, medially and laterally, increasing contact area with ball 1010 in all of these directions.

Without such change of shape the concave area of the dimple 1040 on ball 1010 has limited contact area with flexible toe cap 1030 since these two components may not tessellate well by shape; the dimple 1040 on ball 1010 being concave with a particular radius and flexible toe cap 1030 having a different shape. The new shape of flexible toe cap 1030 may tessellate better with any dimple 1040 transiently created on such ball 1010 than a standard article of footwear and may therefore have a higher area of contact with ball 1010 during the period from initial contact and final separation between flexible toe cap 1030 and ball 1010; such higher area of contact may aid in accurately kicking a ball in a specific direction. Additionally any snap back force occurring when any elastic forces of flexible toe cap 1030 return flexible toe cap 1030 to normal shape, act as another force pushing ball 1010 forward and hence increasing velocity of said ball. The original non-distended shape of flexible toe cap 1030 is shown as broken line 1041 in the lower picture.

Figure 11C:
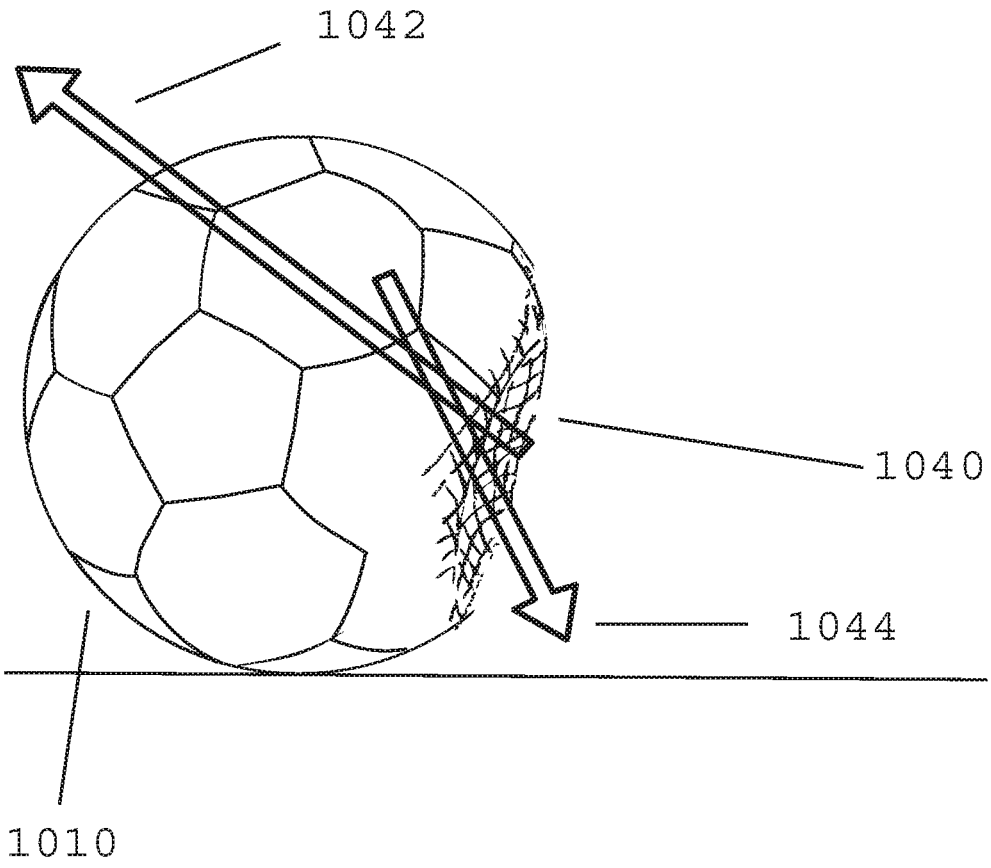
FIG. 11C shows forces involved in a kick

Now referring to FIG. 11C, consider a kick where the intention of the kicker is to impart top spin on a ball 1010 via a kick where the majority of contact with ball 1010 is with a flexible toe cap of an article of footwear, not shown. The vector of movement of an article of footwear and the associated flexible toe cap may pass above the point that was the center of a ball 1010 when resting. The effect of such kick direction may be that much of the contact between ball and the flexible toe cap of an article of footwear, not shown, may be more on the upper part of the ball 1010 between the moment of initial contact and separation of the flexible toe cap and the ball. One effect of the article of footwear and the corresponding flexible toe cap having predominant contact with the upper part of ball 1010 may be that flexible toe cap of the article of footwear may apply not just a forward force to ball 1010 but also a rotational force, creating top spin on ball 1010. One of the factors determining the amount of rotational force applied by the flexible toe cap of the article of footwear, not shown, to a kicked ball may be the surface area of contact between these two components. In this top spin case, initial impact of the flexible toe cap upon the, still resting, kicked ball may create a substantial dimple 1040 in ball 1010, article of footwear removed for illustrative clarity and a grid added to ball 1010 for illustrative clarity. For this top spin case, the forward force 1042 applied to ball 1010 pushes upon the point of contact between dimple 1040 of ball 1010 forward of the flexible toe cap of the article of footwear, not shown. The reaction force 1044 applied by ball 1010 to the flexible toe cap of the article of footwear is generally longitudinal, directed toward the heel section and toward or below the sole. Reaction force 1044 includes a smaller downward component caused by the shearing effect of an in-motion flexible toe cap contacting an initially stationary ball 1010 and such ball having a certain inertia and providing a reaction force on the flexible toe cap that pulls downward on the flexible toe cap as such inertia in the ball prevents the ball from moving at identical velocity to the flexible toe cap of the article of footwear kicking. Such shearing force may be largely due to the fact that, with a top spin kick, the flexible toe cap makes a slightly glancing blow to ball 1010 which causes a dragging effect on the flexible toe cap of the article of footwear generally downward. Force 1044 also includes a compressive component acting generally longitudinally on the flexible toe cap of the article of footwear and toward the heel section.

Figure 11D:
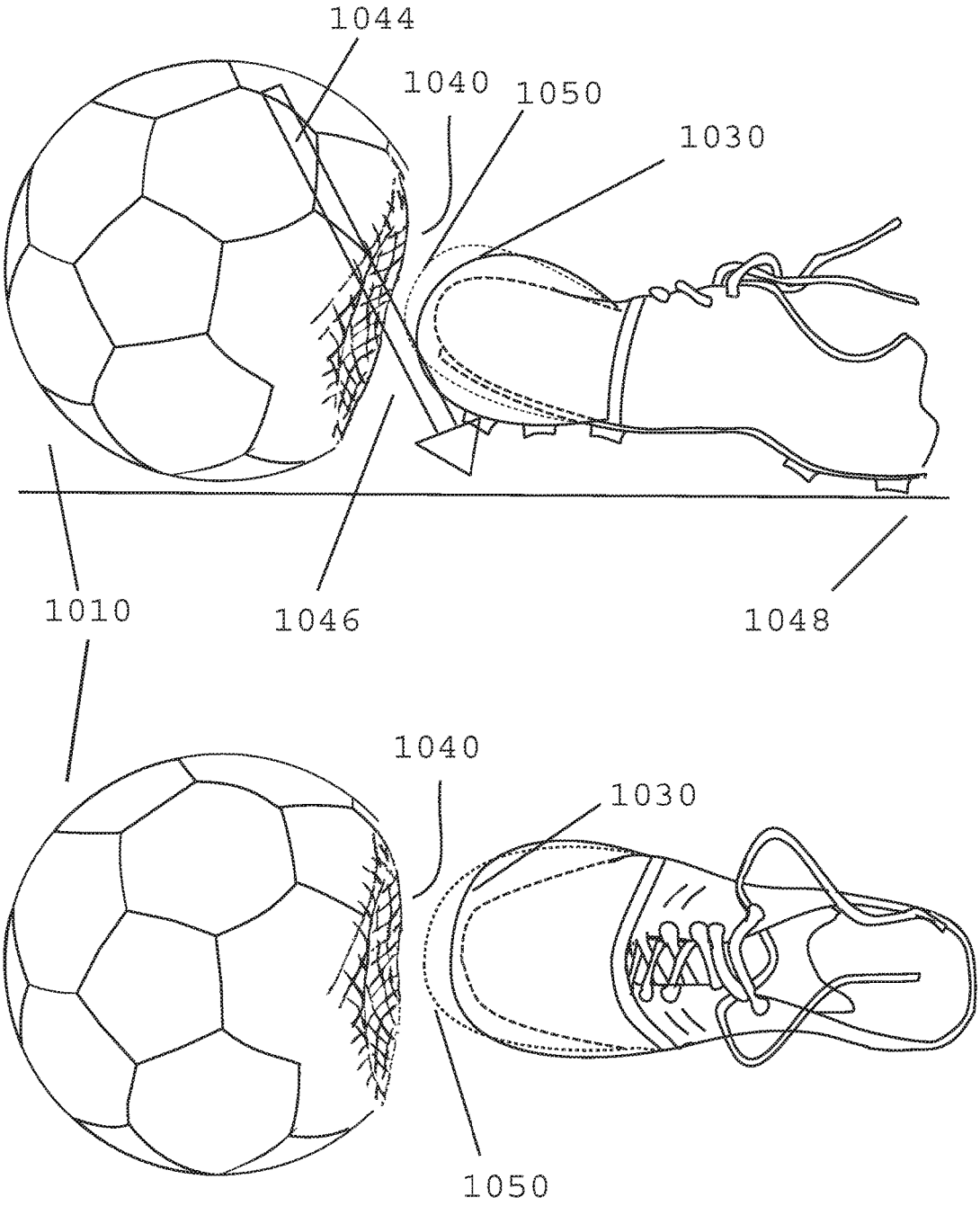
FIG. 11D shows an exemplary aspect as well as forces involved in a top spin kick

Now referring to FIG. 11D, the effect of such slightly downward shearing force 1044 upon a flexible toe cap 1030 that is designed to change shape in directions orthogonal to the direction of the kick may be to push a substantial amount of flexible toe cap downward and also expand the original lateral and medial bounds of flexible toe cap 1030 and create a new shape that may fill in what would have been a gap between the lower part of flexible toe cap 1030 and the concave dimple 1040 on ball 1010 at point 1046. This reduced gap may increase the contact area between flexible toe cap 1030 and ball 1010. Flexible toe cap 1030 may be both compressed and stretched downward and to each side by the reaction force of ball 1010. At the moment shown, ball 1010 has not yet been propelled off ground surface 1048. The new transient shape of flexible toe cap 1030 may better tessellate with ball 1010. Broken line 1050 represents the original, at rest, shape of flexible toe cap 1030.

What may seem surprising about the change of shape of flexible toe cap 1030 is that it moves downward substantially in FIG. 11D even if the majority reaction force on flexible toe cap 1030 from the ball is primarily longitudinal. This is possible because flexible toe cap 1030 is constructed such that longitudinal change of shape is limited so any shearing force of any strength will redirect the predominant longitudinal force to push downward in this case, and rearrange the shape of flexible toe cap 1030 as shown. The components of flexible toe cap 1030 provide little friction in movements orthogonal to the direction of kick, that is, downward, upward, medially and laterally. This allows for substantial change of shape in the preferred directions for specific kick types. The farther toward the heel that the attachment plane of flexible toe cap 1030 is placed, the greater the opportunity for lateral motion, given a particular stiffness of material of flexible toe cap 1030.

Figure 11E:
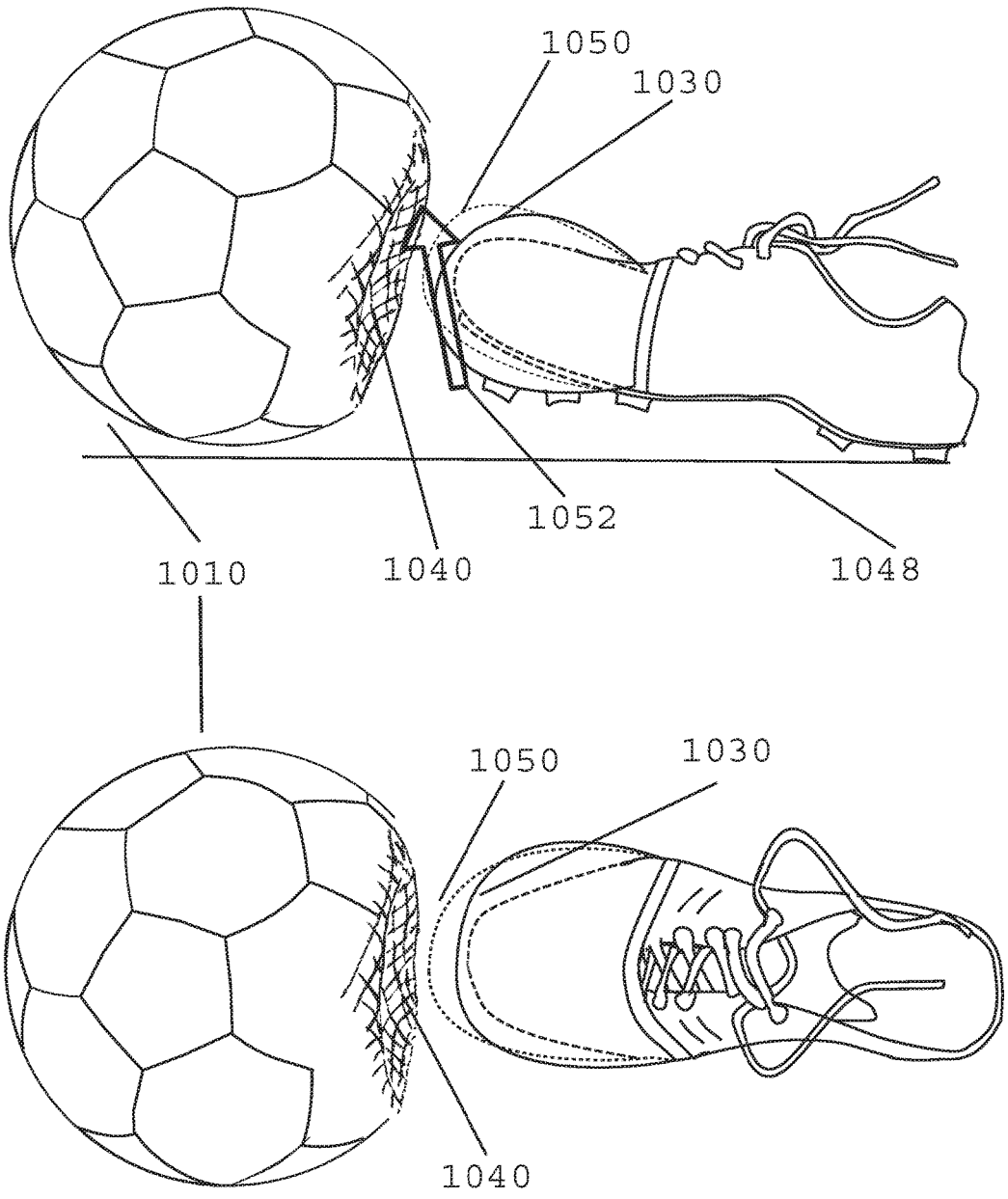
FIG. 11E shows snap back forces involved in a top spin kick

Now referring to FIG. 11E, which represents the same scenario as FIG. 11D but a few moments later, at this moment ball 1010 may have left ground surface 1048 and the point of maximum change in shape of flexible toe cap 1030 may have passed, and elastic and other forces in flexible toe cap 1030 may begin to return flexible toe cap 1030 toward the original resting shape, that is, snap back into position. Such elastic and other forces 1052 act generally upward upon flexible toe cap 1030 to return it to a normal resting position. Any grip or friction between flexible toe cap 1030 and ball 1010 may cause such upward force 1052 to impart a similar vertical movement upon dimple 1040 which in turn creates more top spin upon ball 1010 than would have been the case with just a glancing kick from a standard instance of an article of footwear.

Figure 12A:
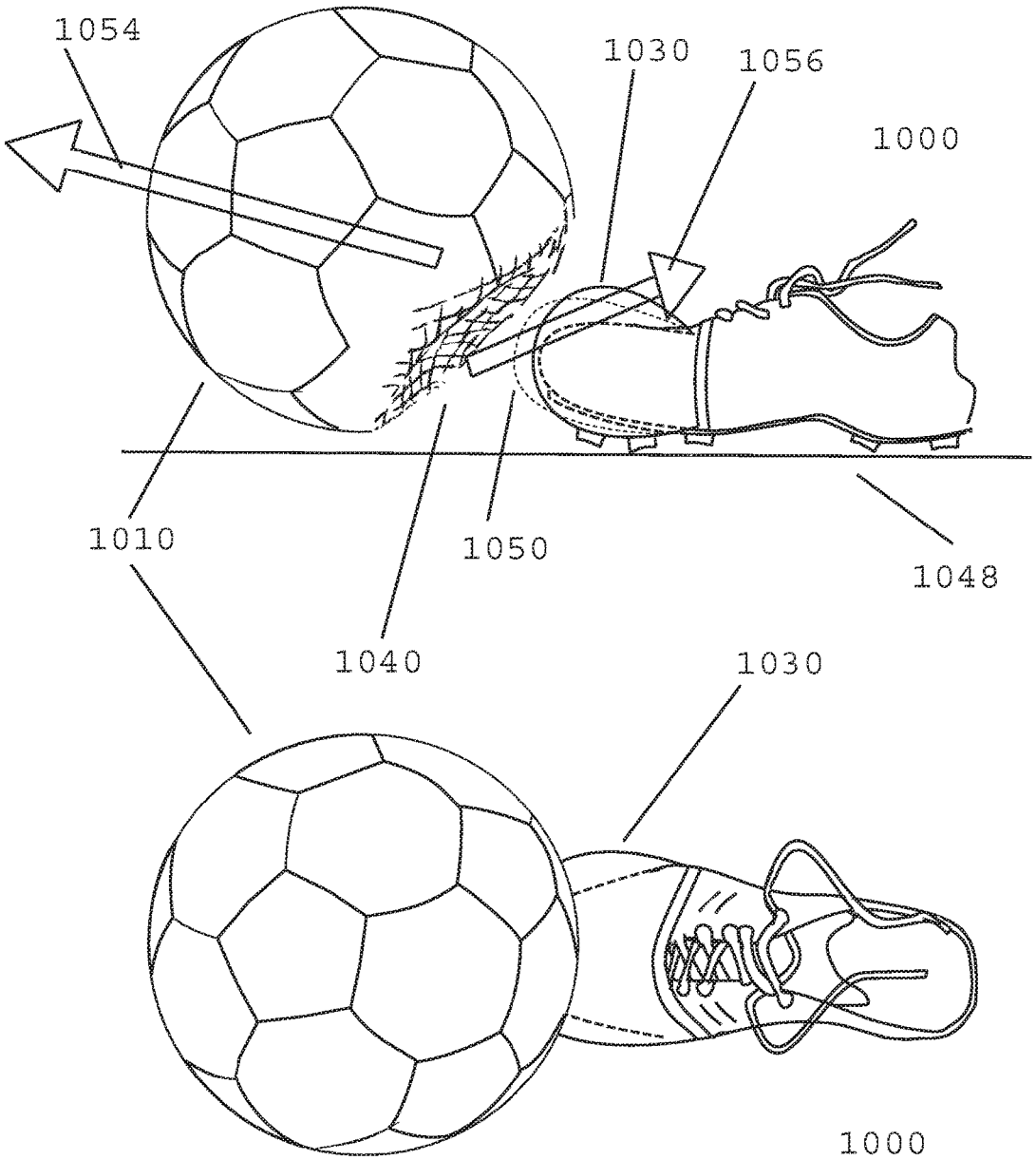
FIG. 12A shows an exemplary aspect performing a back spin kick; change of shape of the article of footwear shown

Now referring to FIG. 12A, consider a kick where the intention of the kicker is to impart back spin on a ball via a kick where the majority of contact with ball 1010 is with flexible toe cap 1030. As was previously illustrated in the lower picture of FIG. 10A, the vector of movement of article 1000 and flexible toe cap 1030 may pass below the point that was the center of a ball when resting. The effect of such kick direction may be that much of the contact between ball and flexible toe cap 1030 may be predominantly on the lower part of ball 1010 between the moment of initial contact and separation of flexible toe cap 1030 and ball 1010. One effect of article 1000 and flexible toe cap 1030 having predominant contact with the lower part of ball 1010 may be that flexible toe cap 1030 applies not just a forward force to ball 1010 but also a rotational force, creating back spin on ball 1010. One of the factors determining the amount of rotational force applied by flexible toe cap 1030 to a kicked ball may be the surface area of contact between flexible toe cap 1030 and the kicked ball 1010. In this back spin case, initial impact of flexible toe cap 1030 upon kicked ball 1010 may create a substantial dimple 1040 in ball 1010. For this back spin case, the forward force 1054 applied to ball 1010 pushes upon the point the point of contact between the dimple 1040 of ball 1010 and flexible toe cap 1030. The reaction force 1056 applied by ball 1010 to flexible toe cap 1030 is generally in a longitudinal direction, directed toward the heel section of article 1000 and slightly upward as shown as force 1056. Force 1056 includes a upward component caused by the shearing effect of an in-motion flexible toe cap 1030 contacting an initially stationary ball 1010 and such ball having a certain inertia and providing a reaction force on flexible toe cap 1030 that pushes upward on flexible toe cap 1030 until ball 1010 moves and back spin occurs. Force 1056 also includes a compressive component acting generally longitudinally toward the heel section of article 1000. The effect of such slightly upward shearing force upon a flexible toe cap 1030 that is designed to change shape in directions orthogonal to the direction of the kick may be to push a substantial amount of flexible toe cap 1030 to into the top of flexible toe cap 1030. An effect of the compressive component of force 1056 may be to also expand the original lateral and medial bounds of flexible toe cap 1030. Force 1056 acts upon flexible toe cap 1030 to create a new shape that may fill in what would have been a gap between the top of flexible toe cap 1030 and the concave dimple 1040 on ball 1010. This reduced gap may increase the contact area between flexible toe cap 1030 and ball 1010. Broken line 1050 represents the original, at rest, shape of flexible toe cap 1030.

Figure 12B:
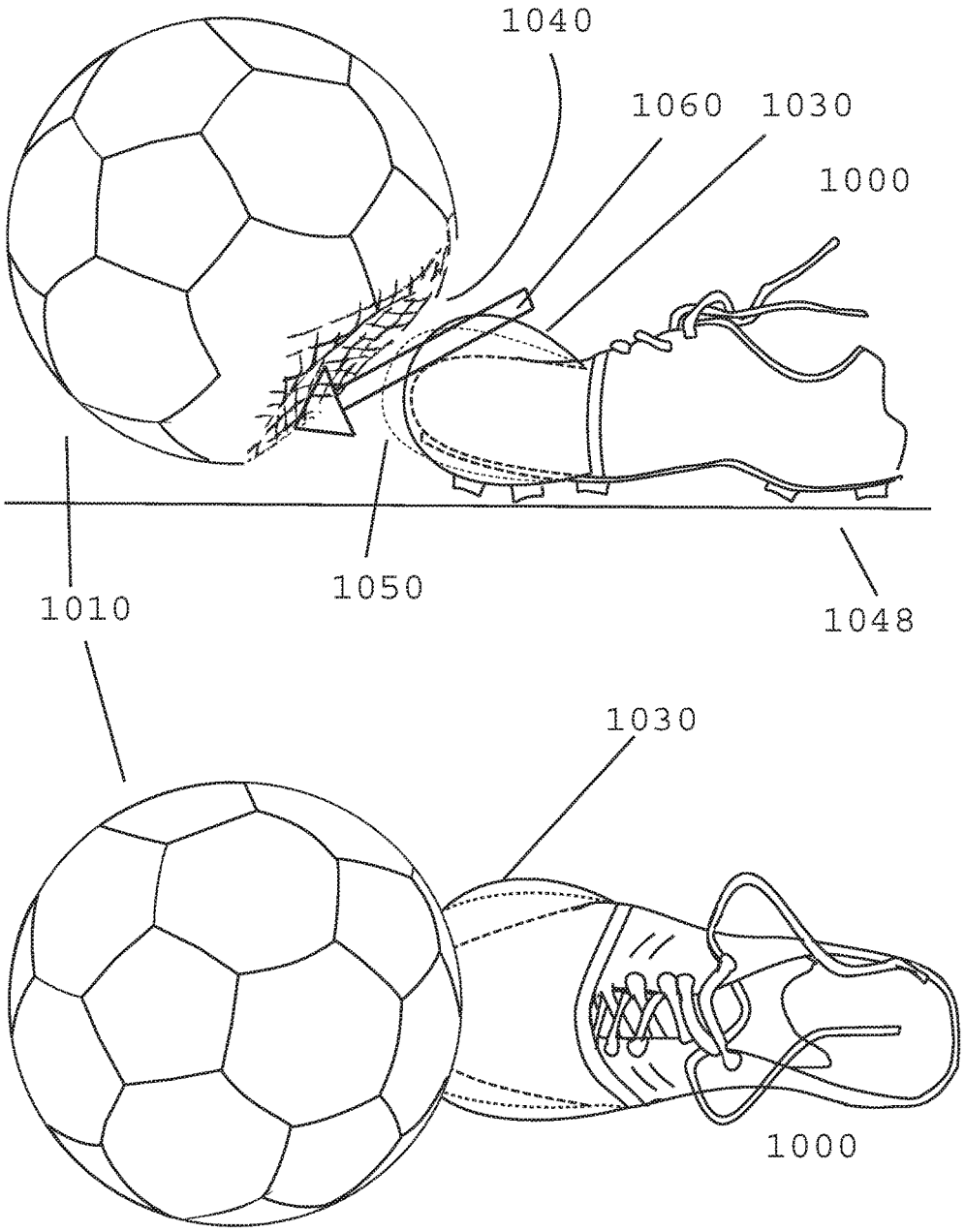
FIG. 12B shows a snap back effect from the distended article of footwear creating spin on a ball in the case of a back spin kick

Now referring to FIG. 12B, which represents the same scenario as FIG. 12A but a few moments later, at this moment ball 1010 may have left ground surface 1048 and the point of maximum change in shape of flexible toe cap 1030 may have passed and elastic and other forces in flexible toe cap 1030 may begin to return flexible toe cap 1030 toward the original resting shape, that is, snap back into position. Such elastic and other forces 1060 act generally downward upon flexible toe cap 1030 to return it to a normal resting position. Any grip or friction between flexible toe cap 1030 and ball 1010 may cause such downward force 1060 to impart a similar downward movement upon dimple 1040 which in turn creates more back spin upon ball 1010 than would have been the case with just a glancing kick from a standard instance of an article of footwear.

Figure 13A:
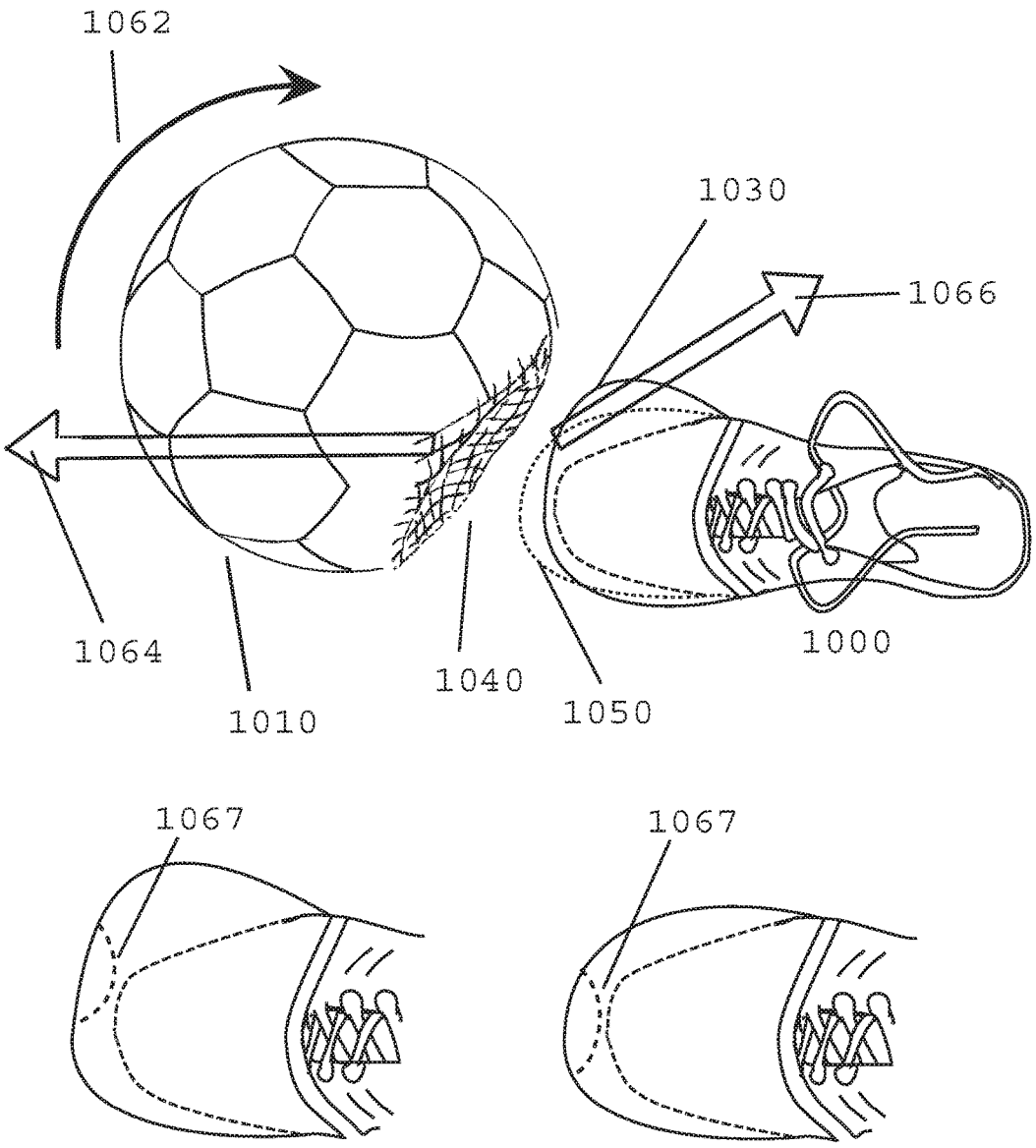
FIG. 13A shows the change of shape of an aspect in the case of a left to right side spin kick as viewed from the perspective of a kicker, as well as the forces involved

Now consider a case where the intention of the kicker is to impart left to right side spin, as viewed from the perspective of the kicker, on a ball via a kick where the majority of contact with ball is with forefoot of the article of footwear worn by the kicker. Referring now to FIG. 13A, the vector of movement of Article 1000 and flexible toe cap 1030 may pass left of the point that was the center of ball 1010 when resting. The effect of such kick direction may be that much of the contact between ball 1010 and flexible toe cap 1030 may be predominantly on the left part of ball 1010 between the moment of initial contact and separation of flexible toe cap 1030 and the ball. One effect of Article 1000 and flexible toe cap 1030 having predominant contact with the left part of ball 1010 may be that flexible toe cap 1030 applies not just a forward force to ball 1010 but also a rotational force, creating left to right side spin on ball 1010. One of the factors determining the amount of rotational force applied by flexible toe cap 1030 to a kicked ball may be the surface area of contact between flexible toe cap 1030 and the kicked ball 1010. In this side spin case, direction of intended spin of ball 1010 is indicated by arrow 1062. Initial impact of flexible toe cap 1030 upon the kicked ball may create a substantial dimple 1040 in ball 1010. A grid has been added for illustrative purposes. For this side spin case, the forward force 1064 applied to ball 1010 pushes upon the point of contact between the dimple 1040 of ball 1010 and flexible toe cap 1030. The reaction force 1066 applied by ball 1010 to flexible toe cap 1030 is generally longitudinal, directed toward the heel section and rightward. Such rightward force may be caused by the shearing effect of an in-motion flexible toe cap 1030 contacting an initially stationary ball 1010 where such ball 1010 has a certain inertia. Such shearing force may pull on flexible toe cap 1030 from left to right as inertia in ball 1010 prevents ball 1010 from moving at identical velocity to flexible toe cap 1030. The effect of such slightly rightward force upon a flexible toe cap 1030 that is designed to change shape in directions orthogonal to the direction of the kick may be to push a substantial amount of flexible toe cap 1030 to the right side of flexible toe cap 1030.

The flexible toe cap 1030 may be made of materials with elastic characteristics such as rubber such that a 5 centimeter diameter vertical surface circle 1067 that is most longitudinally forward on the flexible toe cap 1030 is configured to be able to move laterally with respect to a central axis of the footwear by more than 2 centimeters, from position shown in the lower right hand drawing to position represented by the lower left hand drawing, in a horizontal lateral direction in response to a horizontal lateral force of about 50 Newtons or more, imparted by the shearing forces involved in the type of kick illustrated here.

Force 1066 also includes a compressive component acting generally longitudinally toward heel the heel section of the article of footwear. An effect of such compressive component of force 1066 may be to also expand the original lateral bounds of flexible toe cap 1030 and create a new shape that may fill in what would have been a gap between flexible toe cap 1030 and the concave dimple 1040 on ball 1010. This reduced gap may increase the contact area between flexible toe cap 1030 and ball. Broken line 1050 represents the original, at rest, shape of flexible toe cap 1030. Given that flexible toe cap 1030 is substantially rounded in each direction forward of its attachment points, it is ideally suited to expand into a wider convex shape upon the forces described since a rounded cap with a certain flexibility does widen when pushed from the front.

Figure 13B:
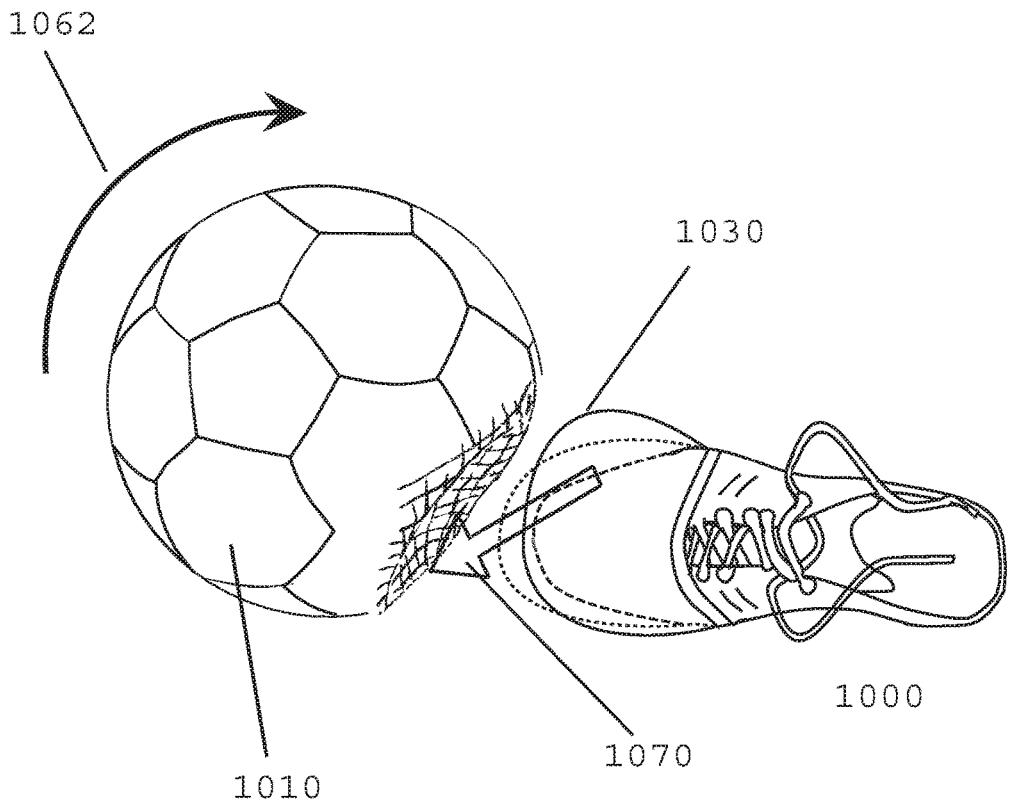
FIG. 13B shows a snap back effect from the distended article of footwear creating left to right side spin on a ball as viewed from the perspective of a kicker

Referring now to FIG. 13B, upon reaching a maximum change of shape of flexible toe cap 1030, such change of shape may be reversed while flexible toe cap 1030 is still in contact with ball 1010. This snap back into original shape of flexible toe cap 1030 may impart a new rotational force 1070 upon the now moving ball 1010. Such new rotational force may act in concert with the prior rotational force already applied and may therefore magnify the spin effect on ball 1010. Such reversal of change in shape may be effected by elastic characteristics of some or all of the materials used to create flexible toe cap 1030 or other spring-back mechanical characteristics of some or all of the materials used to create flexible toe cap 1030 and or Article 1000.

Figure 14A:
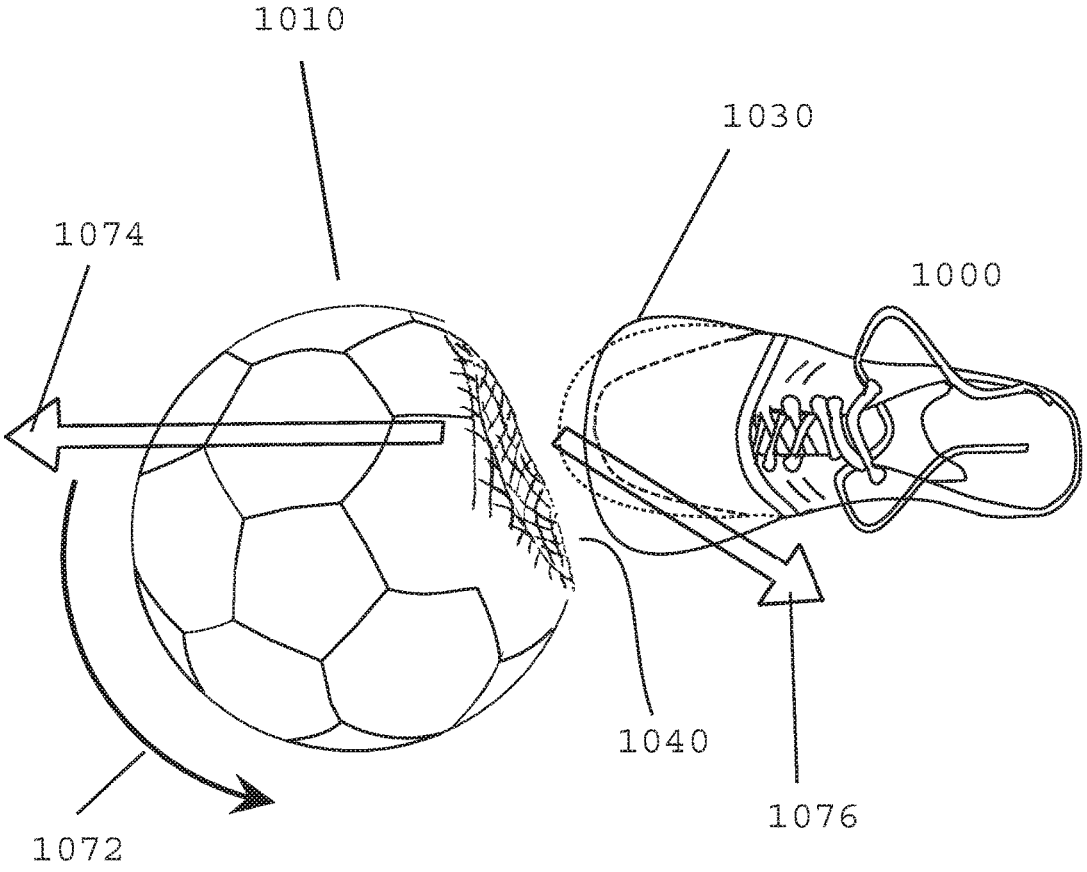
FIG. 14A shows the change of shape in the case of a right to left side spin kick as well as the forces involved

Referring now to FIG. 14A, consider a kick where the intention of the kicker is to impart right to left side spin, as viewed from the perspective of the kicker, on a ball 1010 via a kick where the majority of contact with the ball 1010 is with flexible toe cap 1030 of an article of footwear. The vector of movement of the article of footwear 1000 and flexible toe cap 1030 may pass right of the point that was the center of a ball when resting. The effect of such kick direction may be that the contact between ball and the associated flexible toe cap 1030 may be predominantly on the right part of ball 1010. One effect of article of footwear 1000 and flexible toe cap 1030 having predominant contact with the right part of ball 1010 may be that flexible toe cap 1030 applies not just a forward force to ball 1010 but also a rotational force, creating right to left side spin on ball 1010. One of the factors determining the amount of rotational force applied by flexible toe cap 1030 to a kicked ball may be the surface area of contact between flexible toe cap 1030 and the kicked ball. The direction of intended spin of ball 1010 is indicated by arrow 1072. In this side spin case, initial impact of flexible toe cap 1030 upon the kicked ball may create a substantial dimple 1040 in ball 1010. For this side spin case, the forward force 1074 applied to ball 1010 pushes upon the point of contact between dimple 1040 of ball 1010 and flexible toe cap 1030. The grid shown on ball 1010 has been added for illustrative purposes. The reaction force 1076 applied by ball 1010 to flexible toe cap 1030 is generally longitudinal, directed toward the heel section of the article of footwear and medially leftward. Such leftward force may be caused by the shearing effect of an in-motion flexible toe cap 1030 contacting an initially stationary ball 1010 where such ball has a certain inertia. Such shearing force may pull on flexible toe cap 1030 from right to left as inertia in ball 1010 prevents such ball from moving at identical velocity to flexible toe cap 1030. The effect of such slightly leftward force upon a flexible toe cap 1030 that is designed to change shape in directions orthogonal to the direction of the kick may be to push a substantial amount of flexible toe cap 1030 to the left side of flexible toe cap 1030 as viewed from the perspective of a kicker. Force 1076 also includes a compressive component acting generally longitudinally toward the heel section of the article of footwear. An effect of the compressive component of force 1076 may be to also temporarily expand the original bounds of flexible toe cap 1030 and create a new shape that may fill in what would have been a gap between the right side of flexible toe cap 1030 and the concave dimple 1040 on ball 1010. This reduced gap may increase the contact area between flexible toe cap 1030 and ball.

Figure 14B:
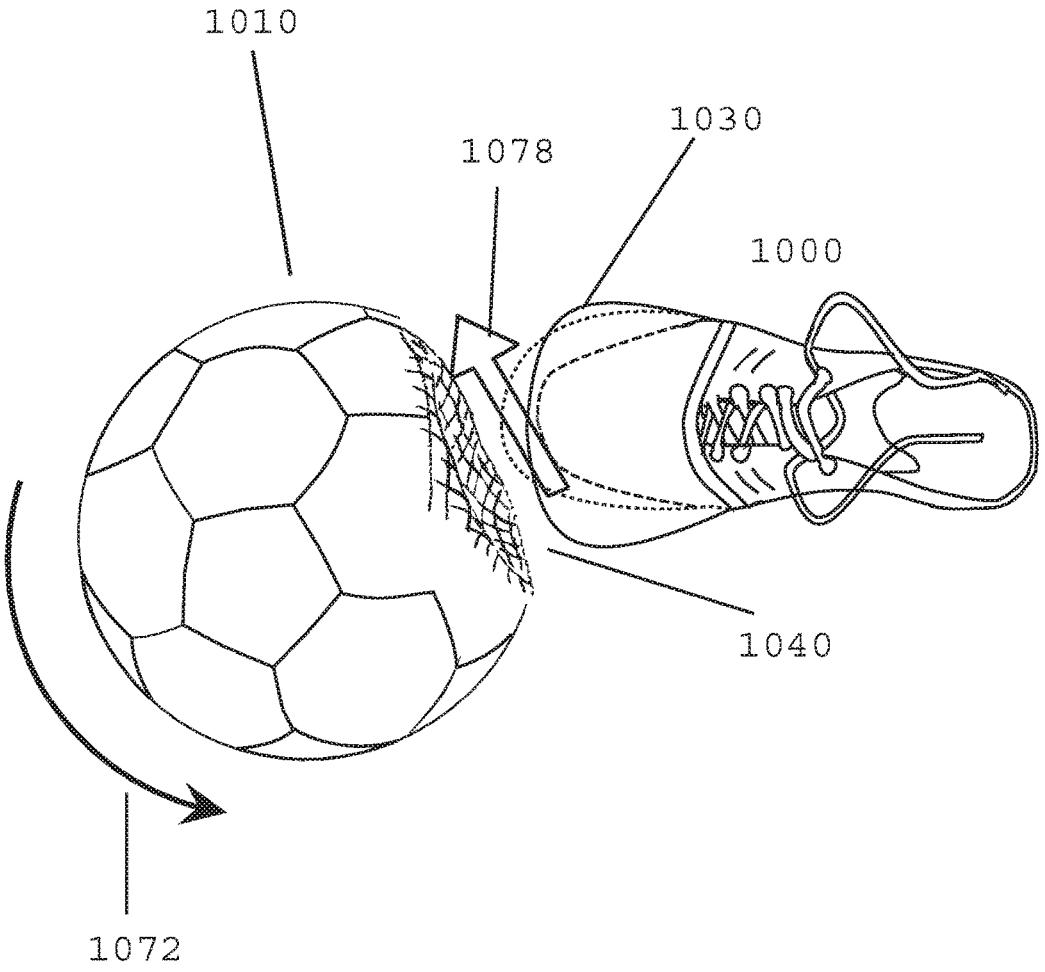
FIG. 14B shows a snap back effect from the distended article of footwear creating spin on a ball in the case of a right to left side spin kick

Now referring to FIG. 14B, upon reaching a maximum change of shape of flexible toe cap 1030, such change of shape may be reversed while flexible toe cap 1030 is still in contact with ball 1010. This snap back into original shape of flexible toe cap 1030 may impart a new rotational force 1078 upon the now moving ball 1010. Such new rotational force may act in concert with the prior rotational force already applied and may therefore magnify the spin effect on ball 1010. Such reversal of change in shape may be effected by elastic characteristics of some or all of the materials used to create flexible toe cap 1030 or other spring back mechanical characteristics of some or all of the materials used to create flexible toe cap 1030 and or Article 1000. The snap back effects described herein are magnified the more the attachment point of flexible toe cap 1030 is moved toward the heel, given a fixed stiffness of construction material of such flexible to cap 1030 since its extra length facilitates more movement due to bending.

Figure 15:
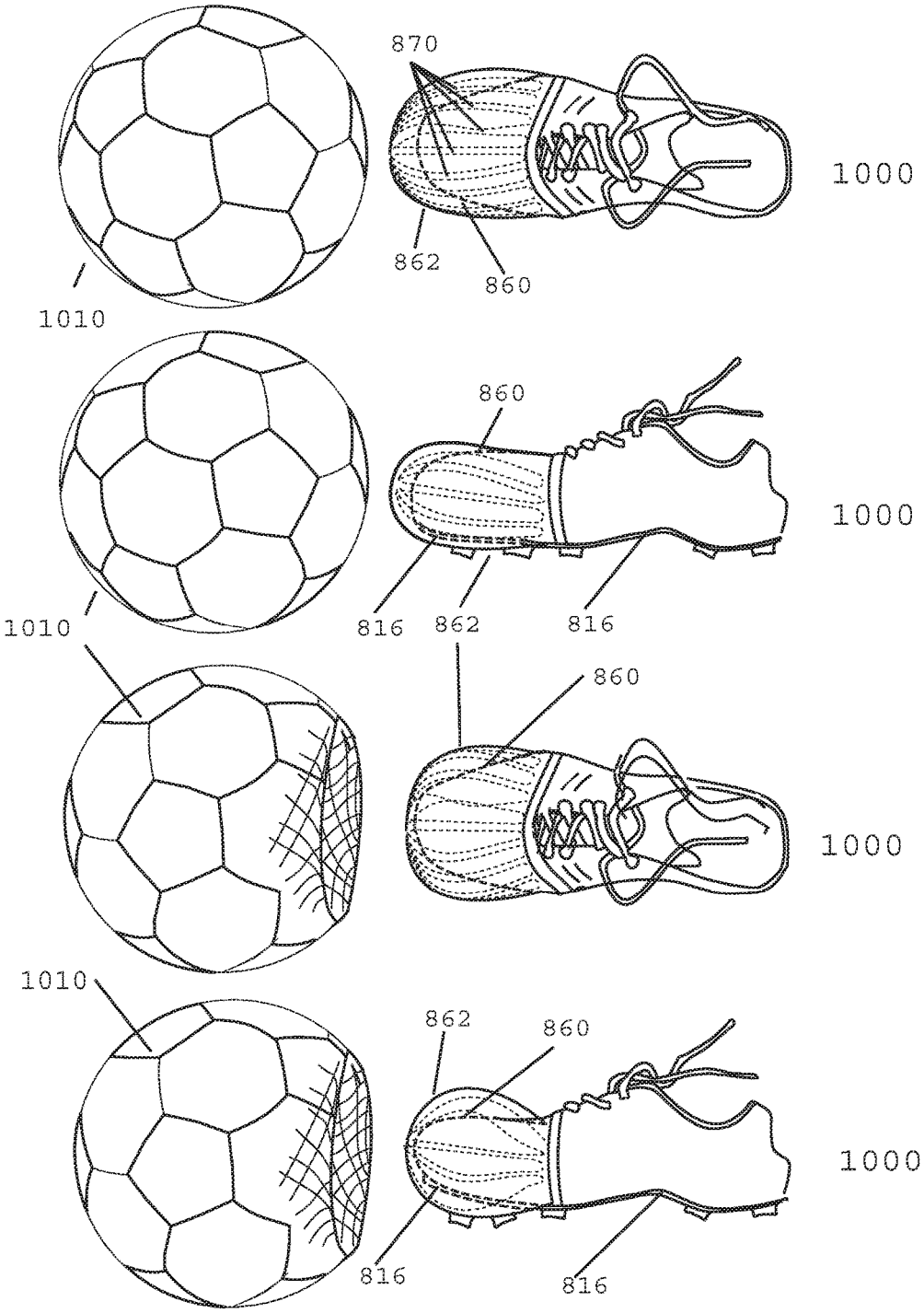
FIG. 15 shows the operation of the embodiment shown in FIGS. 9A and 9B from four views

Referring now to FIG. 15 which summarizes the specific operation of the embodiment depicted in FIG. 9A. The upper two diagrams depict an embodiment of Article 1000 prior to contact with a ball 1010, as viewed from above and the side. There may be significant separation from the inner surface of flexible toe cap 862 and the outer surface of conventional toe cover 860. The lower two diagrams show a moment after contact between ball 1010 and flexible toe cap 862 where the reaction force from a kicked ball 1010 may have forced the most forward area of flexible toe cap 862 closer to, but not touching, toe cover 860. Ball 1010 is distended but is shown separated from article 1000 for illustrative reasons, however the diagram is intended to show operation during actual contact during a kick. The sides of flexible toe cap 862 have bent away from toe cover 860. The new transient shape of flexible toe cap 862 at this moment is such that the area of contact between the kicked ball 1010 and flexible toe cap 862 is much greater than would have been the case in a conventional shoe design where any toe end components are anchored by connection to a relatively rigid shoe sole 816.

Referring to the operation of FIG. 9B, T shaped strengthening struts 874 on the interior of flexible toe cap 862 may be pushed by a wearer against T shaped struts 876 so that these respective struts lock together. One use of such facility may be, prior to a kick, for a wearer to press laterally on the ground with the left or right side of article 862 to create a lateral shearing force which pulls article 862 to the left or right and at the same time presses the T sections article 874 into the T sections 876. Such respective T sections may latch into a static position, maintain the potential energy associated with the shearing force applied by the wearer on article 862. Upon a subsequent kick of a ball, T sections 874 are pressed closer to the heel end of article 800 and release their binding with articles 876 thus allowing the previously described potential energy to be released in the form of a snap back, that provides lateral movement of article 862 to a resting position. Such lateral movement during contact with a ball may impart extra spin upon such ball.

Referring now to FIG. 9C to discuss the operation of such embodiment, upon a wearer of article of footwear 800 running while wearing article 800, the foot bends at the tarsometatarsal joint just before the foot leaves the ground. The effect of such bend is to pull upon strap 880, since the path of strap 880 is no longer straight, which, in turn pulls backward and down upon flexible toe cap 862 which in turn compresses memory material 888 while article 800 is still pressed to the ground. This moves the front end of flexible toe cap 862 longitudinally toward the heel of article 800 and slightly downward, thus moving the end of flexible toe cap 862 that is furthest from the heel, from position 890 to position 895. As the wearer continues in his or her stride article 800 leaves the ground completely. Typically for an athletic run this transition from the point of maximum bend of the foot to separation from the ground may take less than one tenth of a second. Memory material 888 may substantially slow the return to normal shape of ball contact cap 862 due to the slow decompression typical of this material and may take up to a half a second to return to normal position. The effect of the delayed return of flexible toe cap 862 to normal position is to transiently maintain the short length of such flexible toe cap and of article 800 exactly at the moment when a wearer might trip if his or her shoe were too long. By the time a wearer pulls back his or her foot in order to kick a ball, article 800 and flexible toe cap 862 are in their normal positions and exhibit largely the same effects described elsewhere here upon contact with a kicked ball.

Referring now to the operation of FIG. 9D which illustrates the operation of a flexible toe cap 862 attached to a memory material 888 which is in turn attached to a conventional toe end 860 as before. In this embodiment, while running, upon bending of the tarsometatarsal joint of a wearer, flexible toe cap 862, unconstrained to any other part of article 800 at points 898 and 899, may bow outward at points 898 and may crease at points 899. Any such bow or crease may be significantly more than would be possible with a conventional shoe where a semi rigid sole is unable to expand laterally or bend sharply and where an upper is attached to such sole and similarly constrained by this attachment. The effect of this bow and crease is to move the forward end of flexible toe cap 862 from an initial position 890 to a new position 892 which is much closer to conventional toe end 860. Similarly to FIG. 9C, the effect of the delayed decompression of memory material 888 is to delay the return to normal position of flexible toe cap 862 by more than one tenth of a second and up to one half of a second precisely at the moment when the foot of a wearer is leaving the ground. This prevents a wearer from tripping because his or her shoe was too long. By the time a wearer pulls back his or her foot in order to kick a ball, article 800 and flexible toe cap 862 are in their normal positions and exhibit largely the same effects described elsewhere here upon contact with a kicked ball.

Referring now to the operation of FIG. 9E, when the foot of the wearer is lifted above the ground, the area forward of the tarsometatarsal joint of the wearer is unsupported due to the fact that the sole 816 terminates at such joint and also due to the fact that the flexible toe cap 862 may be curved downward from the point of attachment to the sole to a point forward of the end of the toes 904. The stiffness of the flexible toe cap 862 prevents contact between toes 904 and flexible toe cap 862 during a kick yet allows flexible toe cap 862 to move longitudinally towards such toes 904 during a kick in order to both increase the area of contact with a kicked ball and also allows flexible toe cap 862 to move laterally to stretch such flexible toe cap 862 such that it rebounds back to a resting position while still in contact with a kicked ball, hence adding to any spin that might be imparted on such ball. When a wearer subsequently plants his or her foot upon the ground, flexible cap 862 is pushed into contact with toes 904 and the cleats attached to flexible toe cap 862 and sole 816 prevent slip.

Referring to the operation of FIG. 3B to discuss operation of such embodiment, section 220 may or may not be inflatable or deflatable post manufacture. One advantage of providing the facility to change the internal pressure of section 220 may be ability to control how large a bubble will be created with section 220 upon a glancing kick and therefore how much of a dimple on a sports ball can be filled-in transiently. Another possible reason to provide the facility to change the internal pressure of section 220 may be to change the ratio of the two snap back forces, that is the elastic force of skin surrounding section 220, shown in FIG. 3C, and the compression force of air or gas.

Referring to the operation of FIG. 3C, as ball section 220 moves in directions including left, right, upward or downward, under a reaction force from a kicked sports ball, flexible skin 232 is stretched. As such reaction force reduces, flexible skin 232 may snap back ball section 220 to or beyond a pre-kick resting location. As such temporary reaction force from the ball diminishes, two effects may cause flexible skin 232 and components inside of such skin to snap back to the initial position or even further; such effects being the decompression of the previously compressed gas and, secondly, the elastic effect of stretched outer skin 232. Such snap back may cause the kicked ball to spin more than would otherwise be the case without such snap back effect.

Referring to the operation of FIG. 4. On the occasion of a kicker attempting to apply top spin to a ball, the kicker may kick a ball in such a way that a ball imparts a downward reaction force to moveable front piece 324. In this case moveable front piece 324 may move downward rather than stretch downward, as was described in other embodiments, since the vertical part of slot 320 allows protrusion 322 and connected components of moveable front piece 324 to move freely in a vertical downward direction.

If an outer skin is used to cover moveable front piece 324 then such skin may have elastic characteristics such that the outer skin stretches from the point of fastening 326 with Article 300 during the movement of moveable front piece 324 just described. As the reaction force from the ball begins to diminish, the elastic characteristics of such outer skin may pull moveable front piece 324 back toward the initial resting position where protrusion 322 sits at the cross point of the vertical and horizontal sections of slot 320. The amount and timing of this snap back effect may be modified by the elastic characteristics of any outer skin, if used, and of the characteristics of slot 320 and protrusion 322; such snap back having a magnifying effect on the spin imparted to a ball.

In a related embodiment, no such outer skin may exist, however, moveable front piece 324 may still snap back to a resting position if slots 320 contain springs or other mechanical devices that, when pushed will return to a normal state once force diminishes.

On the occasion of a kicker attempting to apply back spin, or left to right side spin, or right to left side spin, to a ball, protrusion 322, moveable front piece 324 and parts of any outer skin may move upward, right, or left respectively from a resting position at the cross point of the vertical and horizontal sections of slot 320 in the same manner as described for a top spin kick. A similar snap back effect may also apply.

In other embodiments, a combination of mechanical movement and elastic movement may amplify both the change of shape of the flexible toe cap of article 300 when distended and the snap back effect described earlier.

Referring to the operation of FIG. 6, upon a kick intended to impart spin on a ball the shearing reaction force from such ball acting on protrusions 546 may bend such protrusions in the directions described earlier in this document, primarily medially, laterally, up and down. Protrusions 546, or their combination with optional skin 524 may fill in any dimple created on a ball more fully than would be the case with a typical article of footwear, thereby increasing surface are of contact with ball thereby allowing more friction between ball and protrusions 546 or skin 524, thereby imparting more spin on the ball. As the ball begins to move from a stationary position, protrusions 546 may unbend to their natural positions along axis 548 thereby causing the snap back effect described earlier in this document; such snap back effect may cause additional spin to be imparted to the ball.

Figure 16:
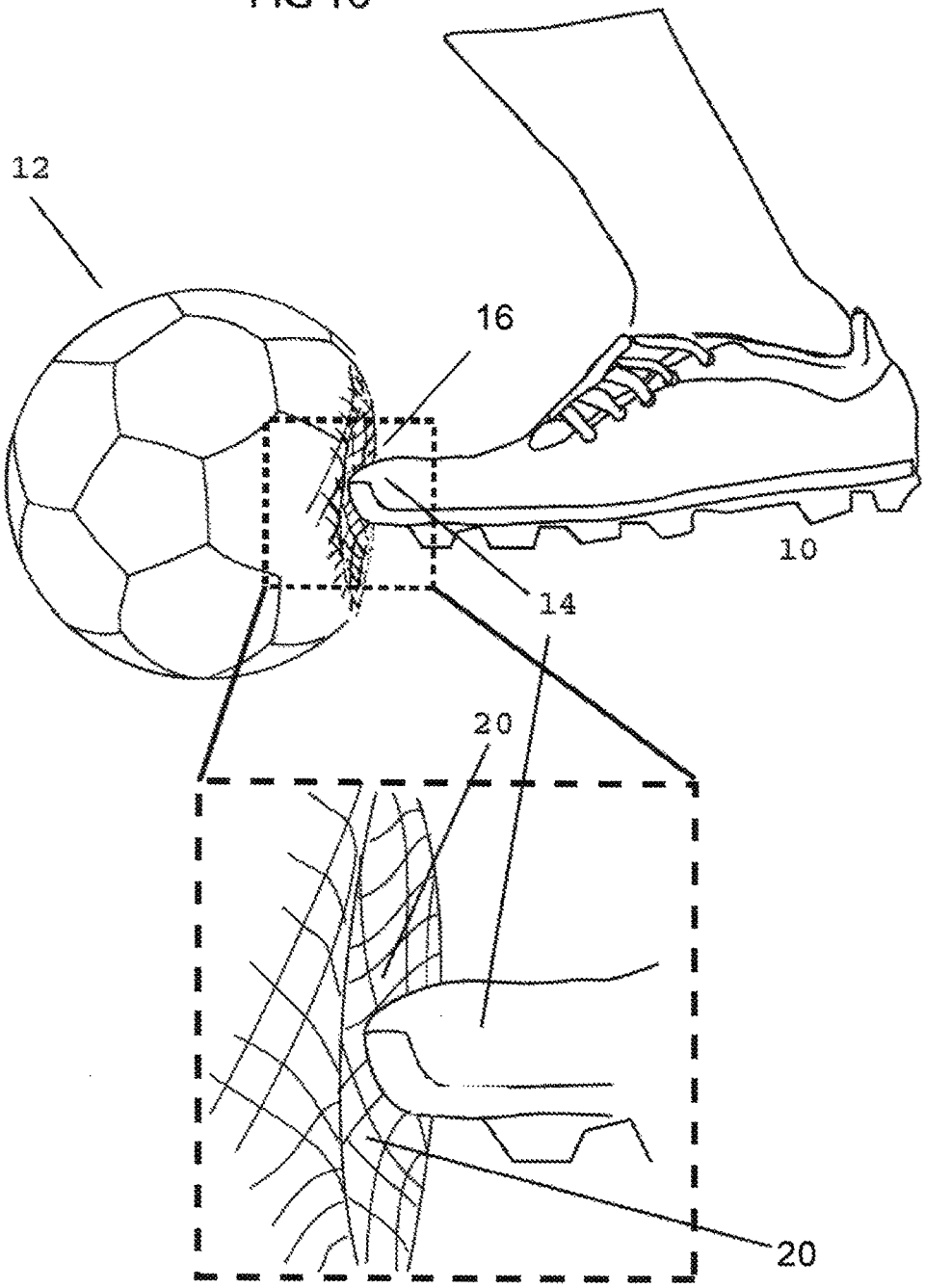
FIG. 16 shows some prior art.

Referring now to FIG. 16 which shows a conventional article of footwear 10 kicking a ball 12. The ball 12 and conventional article of footwear 10 have been separated from one another for convenient viewing. At the point of maximum distortion of ball 12, conventional toe end 14 creates a large dimple 16 on ball 12 but due to the rigid nature of conventional toe end 14, there remains space 20 between much of the dimple 16 and the conventional toe end 14. Much of this rigidity is due to the fact that the semi flexible materials that make up the upper part of the conventional toe end are attached to the relatively inflexible sole.

What is claimed is:

1. A sports shoe comprising:

a sole to which are attached cleats used to prevent slippage along a ground surface;

an upper part; wherein the sole and upper part have a forefoot section, a ball section, a midfoot section and a heel section;

a flexible toe cap attached to the sole and the upper part and configured for primary contact with an object while kicking such object; the flexible toe cap having a top, a bottom and two side sections;

the flexible toe cap is hollow having a generally hemispherical shape and is made from materials with elastic characteristics;

the flexible toe cap is only attached to the sole and the upper part at attachment points which are at the ball section that circles the shoe, the ball section is adapted to reside near or at a tarsometararsal joint of a wearer;

the flexible toe cap is unconnected to the sole at any point forward of the attachment points which are adapted to be forward of the tarsometatarsal joint of the wearer;

the flexible toe cap is substantially rounded in each direction forward of its attachment points, including sections at the bottom of the flexible toe cap and;

the flexible toe cap otherwise does not directly or indirectly touch the remainder of the sports shoe.

2. The sports shoe of claim 1 wherein a 5 centimeter diameter vertical surface circle that is a most longitudinally forward point on the flexible toe cap, the 5 centimeter diameter vertical surface circle moves laterally with respect to a central axis, which runs from toe to heel, of the sports shoe by more than two centimeters in each horizontal lateral direction in response to a horizontal lateral force of about 50 Newtons or more.

3. The sports shoe of claim 1 wherein when a longitudinal force of 250 Newtons is applied from a vertical plane pressing longitudinally upon a front of a horizontal flexible toe cap oriented orthogonally to the vertical plane, a most forward point is adapted to move via elastic characteristics, longitudinally as measured parallel to a front section of the sole and toward the heel section of the sports shoe by a distance of at least about 2 centimeters or more as measured from a point where the tarsometatarsal joint of the wearer is adapted to touch the sole.

4. The sports shoe of claim 3 wherein the flexible toe cap has a mechanical stiffness that prevents contact between itself and toes of a wearer or any other part of the sports shoe during the application of the longitudinal force of 250 Newtons.

5. The sports shoe of claim 1 wherein the flexible toe cap is adapted to be rounded at the bottom so that parts of the flexible toe cap slope downward longitudinally toward the front of the sports shoe when the sports shoe is viewed from a side.

6. A sports shoe, comprising:

an upper part;

a sole; wherein the upper part and the sole part have a forefoot section, a ball section, a midfoot section and a heel section;

a flexible toe cap having a top, a bottom, and two side sections;

the flexible toe cap is attached to the sole and attached to the upper part only at attachment points which are at the ball section that circles the shoe, the ball section is adapted to reside near or at a tarsometararsal joint of a wearer;

the flexible toe cap is adapted to be unconnected to the sole and the upper part at any point forward of the attachment points which are adapted to be forward of the tarsometatarsal joint of the wearer and the flexible toe cap is configured for primary contact with an object while kicking such object wherein the flexible toe cap is hollow having a generally hemispherical shape and is made from materials with elastic characteristics;

the flexible toe cap is substantially rounded in each direction forward of its attachment points, including sections at the bottom of the flexible toe cap and;

the flexible toe cap has a particular thickness of materials and curvature and elasticity such that the maximum radius of the flexible toe cap increases by at least 10 percent, including areas at the bottom of the flexible toe cap, during application of a longitudinal force of about 250 Newtons applied through a vertical plane acting upon the toe end of the flexible toe cap.

7. The sports shoe of claim 6 wherein an entire surface, including a surface adapted to be under a user's toes, is adapted to be continuously curved to resemble a fraction of an outer surface of a flattened, generally hemispherical, object.

8. The sports shoe of claim 6 wherein a perimeter that joins the flexible toe cap to the sole and upper resides in a substantially vertical plane.

9. The sports shoe of claim 6 wherein the flexible toe cap has struts running longitudinally from the front of the flexible toe cap toward the attachment points with the sole and upper, such struts being thicker than the skin of the remainder of the flexible toe cap.

10. The sports shoe of claim 1 wherein the flexible toe cap has struts running longitudinally from the front of the flexible toe cap toward the attachment points with the sole and upper, such struts being thicker than the skin of the remainder of the flexible toe cap.

11. The sports shoe of claim 6 wherein;

the sole and upper part cooperate to form a closed toe end; and the flexible toe cap is spaced from a distal end of the closed toe end.

12. The sports shoe of claim 11 wherein the flexible toe cap is spaced from the distal end of the closed toe end by about 10% or more of a radius of the flexible toe cap.

13. A sports shoe comprising;

an upper part;

a sole; wherein the upper part and the sole part have a forefoot section, a ball section, a midfoot section and a heel section;

a flexible toe cap having a top, a bottom, and two side sections;

a flexible toe cap is attached to the sole and attached to the upper part only at attachment points which are at the ball section that circles the shoe, the ball section is adapted to reside near or at a tarsometararsal joint of a wearer; and the flexible toe cap is configured for primary contact with an object while kicking such object wherein;

the flexible toe cap is hollow having a generally hemispherical shape and is made from materials with elastic characteristics;

the flexible toe cap is substantially curved in each direction forward of its attachment points, including sections at the bottom of the flexible toe cap, such that parts of the flexible toe cap adapted to be under toes of a wearer are adapted to slope downward longitudinally toward the front of the sports shoe when the sports shoe is viewed from a side and;

the flexible toe cap has struts running longitudinally from the front of the flexible toe cap toward the attachment points with the sole and upper, such struts being thicker than the skin of the remainder of the flexible toe cap.

14. The sports shoe of claim 13 wherein any cleats attached to the flexible toe cap are adapted to move vertically downward and away from the toes of a wearer in response to a longitudinal force of 250 Newtons applied from a vertical plane pressing longitudinally upon a front of a horizontal flexible toe cap oriented orthogonally to the vertical plane.

15. The sports shoe of claim 13 wherein;

an entirety of the flexible toe cap that is contained in a 5 centimeter diameter vertical surface circle that is a most longitudinally forward point on the flexible toe cap and the 5 centimeter diameter vertical surface circle is made of flexible materials with a particular flexibility, curved shape and thickness such that it is adapted to move laterally with respect to a central longitudinal axis of the sports shoe by more than 2 centimeters in a horizontal lateral direction without direct or indirect contact with the sole in response to a horizontal lateral force of about 50 Newtons or more.

16. The sports shoe of claim 6 wherein parts of the flexible toe cap configured to be under toes of a wearer are adapted to slope downward longitudinally toward the front of the sports shoe when the sports shoe is viewed from the side.

17. The sports shoe of claim 16 wherein the flexible toe cap has a particular thickness of materials, curvature and elasticity such that the maximum radius of the flexible toe cap increases by at least 10 percent, including areas at the bottom of the flexible toe cap during application of a longitudinal force of about 250 Newtons applied through a vertical plane acting upon the toe end of the flexible toe cap.

* * * * *